US010428409B2

(12) United States Patent
Maeda et al.

(10) Patent No.: US 10,428,409 B2
(45) Date of Patent: Oct. 1, 2019

(54) HOT-ROLLED STEEL SHEET WITH EXCELLENT PRESS FORMABILITY AND PRODUCTION METHOD THEREOF

(75) Inventors: Daisuke Maeda, Tokyo (JP); Osamu Kawano, Tokyo (JP); Kazuya Ootsuka, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 377 days.

(21) Appl. No.: 14/005,408

(22) PCT Filed: Mar. 16, 2012

(86) PCT No.: PCT/JP2012/056856

§ 371 (c)(1),
(2), (4) Date: Sep. 16, 2013

(87) PCT Pub. No.: WO2012/128206

PCT Pub. Date: Sep. 27, 2012

(65) Prior Publication Data

US 2014/0000766 A1 Jan. 2, 2014

(30) Foreign Application Priority Data

Mar. 18, 2011 (JP) ..... 2011-061500

(51) Int. Cl.
*C22C 38/00* (2006.01)
*C22C 38/02* (2006.01)
(Continued)

(52) U.S. Cl.
CPC ..... *C22C 38/08* (2013.01); *C21D 8/0226* (2013.01); *C21D 8/0263* (2013.01); *C22C 1/02* (2013.01);
(Continued)

(58) Field of Classification Search
None
See application file for complete search history.

(56) References Cited

U.S. PATENT DOCUMENTS

2003/0196731 A1* 10/2003 Inoue ..... C21D 8/0226 148/320
2004/0035508 A1 2/2004 Okada et al.
2007/0181231 A1* 8/2007 Ueda ..... C21D 9/04 148/584

FOREIGN PATENT DOCUMENTS

JP 4-276024 10/1992
JP 09-170048 6/1997
(Continued)

OTHER PUBLICATIONS

English machine translation of Takahashi et al. (JP2010-090476), JPO, accessed Aug. 12, 2015.*
(Continued)

*Primary Examiner* — Humera N Sheikh
*Assistant Examiner* — Xioabei Wang
(74) *Attorney, Agent, or Firm* — Birch, Stewart, Kolasch & Birch, LLP

(57) ABSTRACT

The issue of the present invention is to provide a hot-rolled steel sheet with excellent press formability and method for producing the steel sheet, wherein the steel sheet has not only hole expandability but also stretch flanging workability by not assessing hole expandability for stretch flanging as conventional but an actual phenomena of side-bend elongation.

To solve the issue, it is confirmed that the steel sheet are excellent in hole expandability and stretch flanging workability, wherein the steel sheet with a certain content of C, Si and Mn is characterized in that, in a metallic structure of said steel sheet, the area fraction of ferrite is 70% or more,
(Continued)

the area fraction of bainite is 30% or less, the area fraction of either one or both of martensite and retained austenite is 2% or less, and with regard to respective average intervals ($L_\Theta$, $L_i$ and $L_{MA}$), average diameters ($D_\Theta$, $D_i$ and $D_{MA}$) and number densities of a cementite, an inclusion and either one or both of martensite and retained austenite ($n_\Theta$, $n_i$ and $n_{MA}$), a void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

5 Claims, 1 Drawing Sheet

(51) Int. Cl.

| | |
|---|---|
| ***C22C 38/04*** | (2006.01) |
| ***C22C 38/06*** | (2006.01) |
| ***C22C 38/08*** | (2006.01) |
| ***C22C 38/18*** | (2006.01) |
| ***C22C 1/02*** | (2006.01) |
| ***C21D 8/02*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |

(52) U.S. Cl.

CPC ..... *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/18* (2013.01); *C22C 38/38* (2013.01); *C21D 2211/003* (2013.01); *C21D 2211/005* (2013.01)

(56) References Cited

FOREIGN PATENT DOCUMENTS

| | | | | |
|---|---|---|---|---|
| JP | 11-080892 | | 3/1999 | |
| JP | 2002-180189 | | 6/2002 | |
| JP | 2005290396 | * | 10/2005 | ..... C21D 9/46 |
| JP | 2006274318 | * | 10/2006 | |
| JP | 2007-009322 | | 1/2007 | |
| JP | 2007-262487 | | 10/2007 | |
| JP | 2009-191360 | * | 8/2009 | |
| JP | 2010-090476 | | 4/2010 | |
| JP | 2010-196163 | * | 9/2010 | |
| JP | 2011-012308 | | 1/2011 | |
| JP | 2011-122188 | * | 6/2011 | |
| WO | WO2012/020847 | * | 2/2012 | |

OTHER PUBLICATIONS

English machine translation of Takagi (JP 2005-290396), EPO, accessed Mar. 10, 2017.*

Dieter et al., "Handbook of Workability and Process Design", Sep. 2003, ASM International, p. 272.*

English machine translation of JP2010-196163, EPO, accessed Apr. 11, 2018.*

Dieter et al., "Handbook of Workability and Process Design", Sep. 2003, ASM International, p. 272-273. (Year: 2003).*

International Search Report dated Jun. 19, 2012 issued in corresponding PCT Application No. PCT/JP2012/056856.

Brazilian Office Action dated Oct. 3, 2018, issued in corresponding Brazilian Patent Application No. 112013023633-7.

* cited by examiner

HOT-ROLLED STEEL SHEET WITH EXCELLENT PRESS FORMABILITY AND PRODUCTION METHOD THEREOF

This application is a national stage application of International Application No. PCT/JP2012/056856, filed Mar. 16, 2012, which claims priority to Japanese Application No. 2011-061500, filed Mar. 18, 2011, the content of which is incorporated by reference in its entirety.

TECHNICAL FIELD

The present invention relates to a hot-rolled steel sheet with excellent press formability suitable for an automobile, and a production method thereof.

BACKGROUND ART

Recently, due to growing worldwide awareness of the environment, it has been strongly demanded in the automotive field to reduce the carbon dioxide emission or improve fuel consumption. For solving these tasks, weight reduction of a vehicle body may be effective, and application of a high-strength steel sheet may be being promoted to achieve the weight reduction. At present, a hot-rolled steel sheet with a tensile strength of a 440 MPa level may be often used for automotive underbody components. Despite the demand for application of a high-strength steel sheet so as to cope with the weight reduction of a vehicle body, a hot-rolled steel sheet having a tensile strength of 500 MPa or more may currently settle for its application to a part of the components. Main causes thereof may include deterioration of press formability associated with an increase in strength.

Many underbody members of an automobile may have a complicated shape to ensure high rigidity. In press forming, various kinds of workings such as burring, stretch flanging and stretching may be applied and therefore, workability responding to these works may be required of the hot-rolled steel sheet as a blank. In general, the burring workability and the stretch flanging workability may be considered to have a correlation with a hole expanding ratio measured in a hole expanding test, and development of a high-strength steel sheet improved in the hole expandability has been heretofore advanced.

As for the measure to enhance the hole expandability, it is said that elimination of a second phase or an inclusion in the structure of a hot-rolled steel sheet may be effective. The plastic deformability of such a second phase or an inclusion may significantly differ from that of the main phase and therefore, when a hot-rolled steel sheet is worked, stress concentration may occur at the interface between the main phase and the second phase or inclusion. In turn, a fine crack working out to a starting point for fracture may be readily generated at the boundary between the main phase and the second phase or inclusion. Accordingly, it may greatly contribute to enhancement of hole expandability to limit the amount of a second phase or an inclusion and thereby reduce the starting point for crack generation as much as possible.

For these reasons, a hot-rolled steel sheet with excellent hole expandability may be ideally a single-phase structure steel, and in a dual-phase structure steel, the difference in the plastic deformability between respective phases constituting the dual-phase structure may be preferably small. That is, it is preferable that the hardness difference between respective phases is small. As the hot-rolled steel sheet excellent in hole expandability in line with such a way of thinking, a steel sheet having a structure mainly composed of bainite or bainitic ferrite has been proposed (for example, Patent Document 1).

CITATION LIST

Patent Literature

Patent Document 1: Japanese Patent Publication (A) H09-170048

Patent Document 2: Japanese Patent Publication (A) 2010-090476

Patent Document 3: Japanese Patent Publication (A) 2007-009322

Patent Document 4: Japanese Patent Publication (A) H11-080892

SUMMARY OF THE INVENTION

Technical Problem

However, even in a hot-rolled steel sheet with improved hole expandability, a crack may be often generated in the stretch flange forming area at the actual press forming, giving rise to inhibition of application of a high-strength steel sheet.

The present inventors have made intensive studies about the cause of crack generation at the actual press forming in a conventional hot-rolled steel sheet, despite excellent hole expandability. As a result, the present inventors have found that forming in a hole expanding test may greatly differ from forming in the actual stretch flanging and even when the hole expandability is excellent, the stretch flanging workability may not be excellent.

The hole expansion ratio indicating hole expandability is an opening ratio when a bored hole is expanded by a punch and a crack generated in the punched end face penetrates the sheet thickness. On the other hand, stretch flanging is a working to stretch the sheet edge part cut by a shear or the like when forming a flange. In this way, forming in a hole expansion test may greatly differ from forming in the actual stretch flanging. Such a difference may cause a difference in the stress state and the strain state of a hot-rolled steel sheet, and the deformation limit amount leading to fracture may be varied. The deformation limit amount may be considered to vary because the metallic structure greatly affecting fracture is changed according to the stress state and the strain state.

The present inventors have found that because of these reasons, even when the hole expandability is increased, the stretch flanging workability is not necessarily high and fracture occurs in the stretch flanging area at the actual press forming. Conventionally, such a finding was not known, and even when a technique aiming at increasing the hole expansion ratio measured in a hole expansion test has been proposed, the stretch flanging workability has not be taken into consideration (for example, Patent Documents 2 and 3). In particular, as in Patent Document 3, the stretch flange characteristics may be evaluated by the hole expansion ratio, and the term "stretch flange characteristics" has been used by performing an evaluation having no connection with the actual stretch flanging.

In addition, the workability of a high-strength steel sheet has been heretofore evaluated also by the "strength-elongation balance" using, as the indicator, a product (TS×EL) of tensile strength (TS) and elongation at break (EL) (for example, Patent Document 4). However, the workability is evaluated by the breaking strength and elongation in a tensile test, which may be different from side bend elongation as in the actual stretch flanging and may not accurately evaluate the workability including stretch flanging workability. Accordingly, in the invention described in Patent Document 4 where the workability is evaluated also by the "strength-elongation balance", acicular ferrite is precipitated in place of bainite to enhance the impact resistance and with respect to the stretch flanging workability, conversely, a void offering a starting point for a crack may be likely to be formed. Furthermore, because of acicular ferrite precipitation, reduction in the ductility may not be avoided.

The present invention pays attention to the actual stretch flanging as well, and an object of the present invention is to provide a hot-rolled steel sheet with excellent press formability, which can be kept from cracking at the stretch flanging and has good hole expandability comparable to conventional techniques, and a production method thereof.

Solution to Problem

The present inventors believe that, in order to encourage application of a high-strength hot-rolled steel sheet to an underbody member of an automobile, it is important to understand factors governing the characteristics of respective workings applied and reflect them in designing the structure of a hot-rolled steel sheet, and made a large number of intensive studies.

In the hole expanding and stretch flanging, a crack generated in the edge part of a steel sheet may grow due to ductile fracture. That is, a plurality of voids may be formed and grow at the interface between martensite or a hard second phase and a soft phase upon application of a strain, and voids may be connected to each other, whereby a crack may develop. Accordingly, forming a structure composed of phases where the strength difference between adjacent phases is small may be an important factor in enhancing the hole expandability as well as the stretch flanging workability.

On the other hand, the present inventors have made investigations on a structure factor affecting the stretch flanging workability by performing a side bend test simulating stretch flanging. As a result, it has been found that even a steel sheet increased in the hole expandability by forming a structure composed of phases having a small strength difference is sometimes low in the side bend elongation. It has been also found that the side bend elongation is governed by the dispersed state of either one or both of martensite and retained austenite (hereinafter, sometimes referred to as MA), a hard second phase of cementite, and a hard second phase particle such as inclusion.

In general, the hole expanding may be a working to expand a bored hole, and the stretch flanging may be a working to stretch a steel sheet marginal part when forming a flange by bending a steel sheet edge part. In either working, a strain may decrease toward the inside of the workpiece from the edge part. The decrease ratio here may be called a stain gradient. However, the stretch flanging may be a working establishing a small strain gradient as compared with the hole expanding and therefore, paying attention to the strain gradient, a fine crack generated in the punching edge part may be more likely to develop to the inside in the stretch flanging than in the hole expanding.

It has been thus found that even when the hole expandability is excellent, a crack develops at the stretch flanging to cause fracture depending on the existing state (dispersed state) of a phase or particle contributing to crack propagation, such as MA, cementite and inclusion in the steel sheet. That is, MA, cementite and an inclusion may work out to a starting point for void formation and therefore, be preferably reduced as much as possible. However, because of, for example, addition of carbon so as to achieve high strength or limitation of the refining technology, complete elimination of such a phase or a particle may be difficult.

Also, in the conventional techniques described above, hole expandability may be equated with stretch flanging workability and since relatively good hole expandability may be obtained, elimination of MA, cementite and an inclusion and existing condition thereof had not been studied.

Accordingly, the present inventors have made further intensive studies on the technique for improving the existing state (dispersed condition) of MA, cementite and an inclusion and the stretch flanging workability. As a result, a void formation/connection index L (formula 1) reflecting the dispersed state of MA, cementite and an inclusion has been proposed, and it has been found that this index exhibits a strong correlation with the side bend elongation indicating stretch flangeability. That is, the textural structure is controlled to satisfy the strength and hole expandability and at the same time, have a high numerical value as the void formation/connection index L, whereby a hot-rolled steel sheet having excellent press formability and good hole expandability can be obtained.

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities (pieces/$\mu m^2$) of a cementite, an inclusion and MA, respectively, $D_\theta$, $D_i$ and $D_{MA}$: average diameters (μm) of a cementite, an inclusion and MA, respectively, and $L_\theta$, $L_i$ and $L_{MA}$: average intervals (μm) of a cementite, an inclusion and MA, respectively.

Also, the present inventors have ascertained, from their verification of the relationship between the void formation/connection index L and the side bend elongation, that when the void formation/connection index L becomes 11.5 ($\mu m^{-1}$) or more, the side bend elongation gradient is increased and more sensitively affects the stretch flange workability. Accordingly, it has been found that by controlling the structure to have a void formation/connection index L of 11.5 ($\mu m^{-1}$) or more, voids formed are less likely to be connected and higher stretch flanging workability is obtained.

The present invention has been accomplished based on these findings, and the gist of the present invention resides in the followings.

(1)

A hot-rolled steel sheet with excellent press formability, comprising, in mass %, C: 0.03 to 0.10%, Si: 0.5 to 1.5%, Mn: 0.5 to 2.0%, and the balance of Fe and unavoidable impurities, as impurities, P: limited to 0.05% or less, S: limited to 0.01% or less, Al: limited to 0.30% or less, N: limited to 0.01% or less, wherein in the metallic structure of said steel sheet, the area fraction of ferrite is 70% or more, the area fraction of bainite is 30% or less, the area fraction of either one or both of martensite and retained austenite is 2% or less, and with regard to respective average intervals, average diameters and number densities of cementite, an inclusion and either one or both of martensite and retained austenite, a void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities of a cementite, an inclusion and either one or both of martensite and retained austenite, respectively, and the unit is pieces/$\mu m^2$;

$D_\theta$, $D_i$ and $D_{MA}$: average diameters of a cementite, an inclusion and either one or both of martensite and retained austenite, respectively, and the unit is μm; and $L_\theta$, $L_i$ and $L_{MA}$: average intervals of a cementite, an inclusion and either one or both of martensite and retained austenite, respectively, and the unit is μm.

(2)

The hot-rolled steel sheet with excellent press formability as set force in (1), wherein said steel sheet further comprises one or more of, in mass %, Nb: 0.08% or less,
Ti: 0.2% or less,
V: 0.2% or less,
W: 0.5% or less,
Mo: 0.4% or less,
Cu: 1.2% or less,
Ni: 0.6% or less,
Cr: 1.0% or less,
B: 0.005% or less,
Ca: 0.01% or less, and
REM: 0.01% or less.

(3)

The hot-rolled steel sheet with excellent press formability as set force in (1) or (2), wherein in said steel sheet, the X-ray random intensity ratios of {211} plane parallel to a surface of the steel sheet at the ½ thickness position, the ¼ thickness position and the ⅛ thickness position in the thickness direction from the surface are 1.5 or less, 1.3 or less, and 1.1 or less, respectively.

(4)

A method for producing a hot-rolled steel sheet with excellent press formability, comprising:

a step of subjecting a slab made of a steel comprising, in mass %,

C: 0.03 to 0.10%,
Si: 0.5 to 1.5%,
Mn: 0.5 to 2.0%, and the balance of Fe and unavoidable impurities, as impurities, P: limited to 0.05% or less,
S: limited to 0.01% or less,
Al: limited to 0.30% or less,
N: limited to 0.01% or less, reheating the slab to a temperature of 1,150° C. or more and holding the slab for 120 minutes or more, thereafter performing rough rolling the slab, a step of performing finish rolling such that the end temperature becomes between $Ae_3$−30° C. and $Ae_3$+30° C., a step for performing primary cooling to a temperature between 510 and 700° C. at a cooling rate of 50° C./s or more, a step of performing air cooling for 2 to 5 seconds, a step of performing secondary cooling at a cooling rate of 30° C./s or more, a step of performing coiling at a temperature of 500 to 600° C., and a step of performing cooling to 200° C. or less at an average cooling rate of 30° C./h or more to obtain a steel sheet, wherein:

$$Ae_3 = 937 - 477C + 56Si - 20Mn - 16Cu - 15Ni - 5Cr + 38Mo + 125V + 136Ti - 19Nb + 198Al + 3315B \quad \text{(formula 2)}$$

wherein C, Si, Mn, Cu, Ni, Cr, Mo, V, Ti, Nb, Al and B represent the contents of respective elements, and the unit is mass %.

(5)

The method for producing a hot-rolled steel sheet with excellent press formability as set force in (4), wherein the total pass-to-pass time of final 4 stands in said finish rolling is 3 seconds or less.

(6)

The method for producing a hot-rolled steel sheet with excellent press formability as set force in (4) or (5), wherein said slab further comprises one or more of, in mass %, Nb: 0.08% or less,
Ti: 0.2% or less,
V: 0.2% or less,
W: 0.5% or less,
Mo: 0.4% or less,
Cu: 1.2% or less,
Ni: 0.6% or less,
Cr: 1.0% or less,
B: 0.005% or less,
Ca: 0.01% or less, and
REM: 0.01% or less.

(7)

The method for producing a hot-rolled steel sheet with excellent press formability as set force in (4) or (5), wherein with regard to respective average intervals, average diameters and number densities of a cementite, an inclusion and either one or both of martensite and retained austenite in the metallic structure of said steel sheet, the void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities of a cementite, an inclusion and either one or both of martensite and retained austenite, respectively, and the unit is pieces/$\mu m^2$;

$D_\theta$, $D_i$ and $D_{MA}$: average diameters of a cementite, an inclusion and either one or both of martensite and retained austenite, respectively, and the unit is μm; and $L_\theta$, $L_i$ and $L_{MA}$: average intervals of a cementite, an inclusion and either one or both of martensite and retained austenite, respectively, and the unit is μm.

(8)

The method for producing a hot-rolled steel sheet with excellent press formability as set force in (6), wherein with regard to respective average intervals, average diameters and number densities of a cementite, an inclusion and either one or both of martensite and retained austenite in the metallic structure of said steel sheet, the void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities of a cementite, an inclusion and either one or both of martensite and retained austenite, respectively, and the unit is pieces/$\mu m^2$;

$D_\theta$, $D_i$ and $D_{MA}$: average diameters of a cementite, an inclusion and either one or both of martensite and retained austenite, respectively, and the unit is μm; and $L_\theta$, $L_i$ and $L_{MA}$: average intervals of a cementite, an inclusion and either one or both of martensite and retained austenite, respectively, and the unit is μm.

Advantageous Effects of Invention

According to the present invention, a high-strength hot-rolled steel sheet excellent in the ductility, hole expandability and stretch flangeability can be obtained.

DESCRIPTION OF EMBODIMENTS

Figure 1:
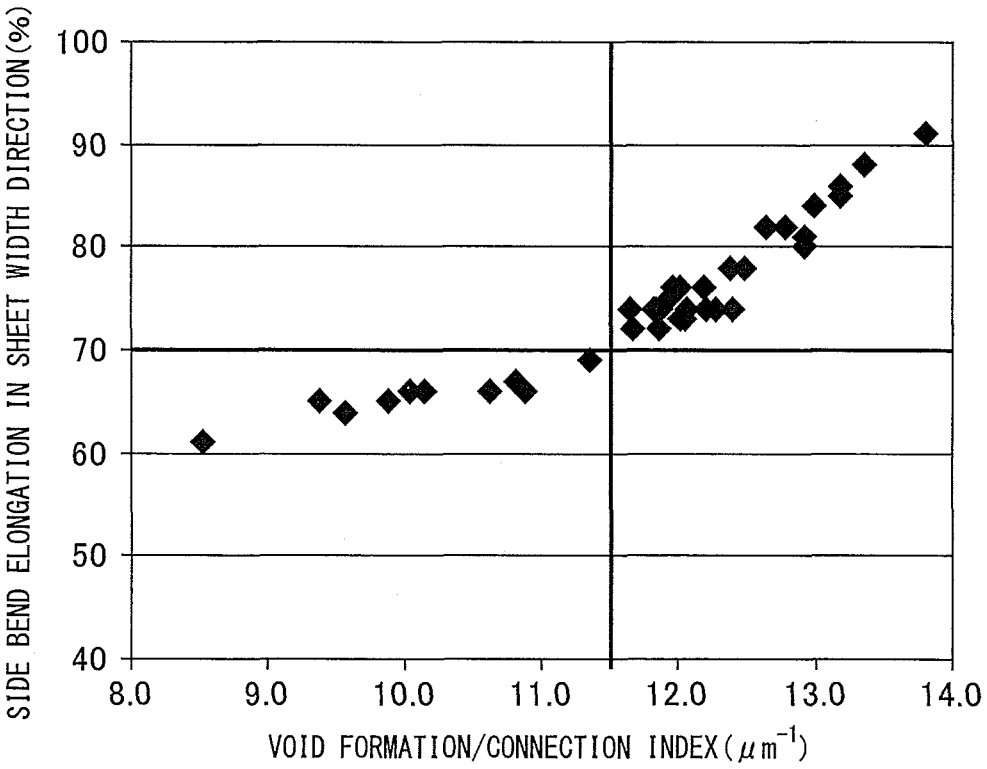
FIG. 1 is a view showing the relationship between the void formation/connection index and the side bend elongation, where data having TS (tensile strength) of 540 MPa or more, λ of 110% or more and elongation at break of 30% or more are plotted.

The present invention pays attention to the actual stretch flanging as well, and an object of the present invention is to provide a hot-rolled steel sheet with excellent press formability, which can be kept from cracking at the stretch flanging and has good hole expandability comparable to conventional techniques, and a production method thereof. Accordingly, as for the characteristics other than stretch flange workability, the aim may be to have characteristics equivalent to those of conventional steel sheets. Specifically, the following numerical values equivalent to those of a conventional steel having a tensile strength of a 540 MPa level may be set as the goals for targeted mechanical characteristics.

Tensile strength: 540 MPa

Elongation at break: 30%

Hole expansion ratio: 110%

The stretch flanging workability may be evaluated by sand bend elongation.

The present invention may be described in detail below.

[Void Formation/Connection Index L]

As described above, even a hot-rolled steel sheet improved in hole expandability by forming a structure composed of phases small in the strength difference between respective phases in the crystalline structure may have low side bend elongation in some cases. In the course of determining the reason thereof, it has been found that the side bend elongation is governed by the existing state (dispersed state) of either one or both of martensite and retained austenite (hereinafter, sometimes referred to as MA), a hard second phase such as cementite, and a hard second phase particle such as inclusion. The present inventors have discovered a void formation/connection index L defined by formula 1 as an indicator of existing state (dispersed state) of such a second phase or inclusion or the like. The void formation/connection index L that may become a key part of the present invention is described below.

The hole expanding may be a working to expand a bored hole and in the hole expanding, the punching edge part may be severely worked. The stretch flanging may be a working to stretch a steel sheet marginal part when forming a flange by bending a steel sheet edge part. The stretch flanging may be a working establishing a small strain gradient as compared with the hole expanding and therefore, a fine crack generated in the punching edge part may be likely to develop to the inside, leading to fracture with a smaller strain amount than in the hole expanding.

Crack propagation may be caused due to connection of voids formed starting from MA, a hard second phase such a cementite, and a hard second particle such as inclusion (hereinafter, unless otherwise indicated, the hard second phase and the hard second particle are collectively referred to as "hard second phase and the like"). Therefore, in the stretch flanging, control of this hard second phase and the like is important more than in the hole expanding. In other words, even when high hole expandability may be realized by constituting a metallic structure having phases small in the strength difference between respective phases, only with this configuration, high stretch flanging workability may not be obtained depending on the distribution of MA, cementite and an inclusion.

From the results of investigation, the present inventors have deduced that ease of connection of voids, i.e, ease of crack propagation, is greatly affected by the void formation/connection index L determined from the dispersed state of the hard second phase and the like.

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities (pieces/$\mu m^2$) of a cementite, an inclusion and either one or both of martensite and retained austenite, respectively, $D_\theta$, $D_i$ and $D_{MA}$: average diameters (μm) of a cementite, an inclusion and either one or both of martensite and retained austenite, respectively, and $L_\theta$, $L_i$ and $L_{MA}$: average intervals (μm) of a cementite, an inclusion and either one or both of martensite and retained austenite, respectively.

In formula 1, with respect to each of MA, a cementite and an inclusion, a value obtained by dividing the average interval by the square of the average diameter may be taken as the effective interval, and the weighted average of effective intervals of MA, a cementite and an inclusion may be taken as the void formation/connection index L. The void formation/connection index L may be qualitatively described as follows. The probability of void generation may be proportional to the surface area ($D^2$) of the hard second phase, and ease of connection of voids may be inversely proportional to the distance between respective phases (interval $L_0$ between respective phases). Accordingly, ($D^2/L_0$) may be considered as an indicator of ease of void formation/connection. The reciprocal thereof may become an indicator of difficulty of void formation/connection of, that is, an indicator of good stretch flanging workability.

Here, using subscripts θ, i and MA for a cementite, an inclusion and MA, respective average intervals $L_\theta$, $L_i$ and $L_{MA}$, may be determined according to formula 3. In formula 3, $f_\theta$, $f_i$ and $f_{MA}$ may represent area fractions of cementite, an inclusion and MA, respectively, and $D_\theta$, $D_i$ and $D_{MA}$ may represent average diameters (μm) of a cementite, an inclusion and MA, respectively. The area fraction may be a ratio of each of a cementite, an inclusion and MA, in the whole investigation range. The average diameter may be an average value of a major axis and a minor axis of each of a cementite, an inclusion and MA investigated. The methods for measuring the area fraction, number density and average interval may be described in Examples later.

In formula 3, an average interval (μm) assuming an isotropic distribution may be obtained.

$$L_x = \left\{1.25 \times \left(\frac{\pi}{6 f_x}\right)^{0.5} - \left(\frac{2}{3}\right)^{0.5}\right\} \times D_x \quad \text{(formula 3)}$$

In the case where the hard second phase and the like have the same size, ease of connection of voids formed starting from such a phase may depend on the effective interval, because as the effective interval is large, voids may become more difficult to connect. Also, in the present invention, a quotient obtained by dividing the average interval by the square of the average diameter may be taken as the effective interval (unit may be $\mu m^{-1}$). This is to reflect the finding that ease of connection of voids may not be determined merely by an average interval and as the size of the hard second phase and the like is smaller, voids formed starting from such a phase may become finer and difficult to connect. The reason why as the size of the hard second phase and the like is smaller, voids become difficult to connect may not be clearly known but may be considered because as the void size is smaller, the surface area of a void per unit volume is larger, i.e, the surface tension is increased, as a result, a void does not easily occur.

Also, when the hard second phase and the like are small, not only a void may become difficult to grow but also connection of voids may be less likely to occur. Accordingly, as the hard second phase and the like are smaller and as the void formation/connection index L is larger, the strain amount leading to fracture may be increased. The reason for the square of the average diameter may be considered because stress generated around the hard second phase and the like by working is proportional to the size but, on the other hand, the stress per unit surface area of the hard second phase and the like is reduced and a void becomes difficult to grow.

In addition, ease of void formation may differ depending on the kind of the hard second phase and the like, and it is confirmed that an inclusion may readily form a void as compared with MA and cementite. Because of this, the term of an inclusion on weighted averaging may be multiplied by a coefficient. The coefficient may be a ratio between the number of voids formed per one inclusion and the number of voids formed per one MA/cementite and was set to 2.1 from the observation results.

As shown in FIG. 1, it has been confirmed that a strong correlation exists between the void formation/connection index L taking into account ease of void formation and the side bend elongation. Furthermore, it has been confirmed that the percentage increase in the side bend elongation rises when the void formation/connection index becomes 11.5 ($\mu m^{-1}$) or more. In other words, the stretch flanging workability can be greatly improved by setting the void formation/connection index L to 11.5 ($\mu m^{-1}$) or more.

The reason why the side bend elongation is greatly enhanced when the void formation/connection index becomes 11.5 ($\mu m^{-1}$) or more may be considered because connection of voids is inhibited, but detailed reasons thereof may not be clear. However, it is believed that the size of the hard second phase and the like may affect the void formation, more specifically, fine formation of the hard second phase and the like may produce an effect that not only connection of voids is less likely to occur but also a void itself is hardly formed. Furthermore, the strain amount leading to fracture may be attributed to production/connection of voids originated in a hard second phase and the like present in the steel material structure and may be determined by the kind, amount and size of the hard second phase and the like. Accordingly, even when the ingredients of the steel material are changed, the critical void formation/connection index at which the effects of the present invention are obtained may not be changed.

Incidentally, MA and cementite of which area fraction, average interval and average diameter must be taken into account may be those having an area of 0.1 $\mu m^2$ or more in the cross-section of the hot-rolled steel sheet, because MA and cementite smaller than that may be unlikely to significantly affect the side bend elongation. The inclusion of which area fraction, average interval and average diameter must be taken into account may be an inclusion having an area of 0.05 $\mu m^2$ or more in the cross-section of the hot-rolled steel sheet, because an inclusion smaller than that may be unlikely to significantly affect the side bend elongation.

The area fraction, average interval and average diameter may be determined by image analysis. A measurement sample may be prepared by LePera etching in the case of MA and picral etching in the case of cementite, an optical micrograph of the sample may be binarized, and the area fraction and the average diameter can be determined using an image analysis software (for example, Image Pro). As for the inclusion, the area fraction and the average diameter can be determined using a particle analysis software (for example, particle finder) by FE-SEM. From the values obtained, the interval assuming an isotropic distribution can be obtained as the average interval.

As described above with respect to the void formation/connection index L, the stretch flanging workability of a steel sheet may be evaluated also by the void formation/connection index. The stretch flangeability can be evaluated by the void formation/connection index without confirming it by actually testing the steel sheet, so that the quality control efficiency for a steel sheet can be remarkably enhanced.

[Ingredients of Steel Sheet]

The hot-rolled steel sheet of the present invention and the ingredients of a steel used for the production thereof are described in detail below. Incidentally, "%" that is the unit for the content of each ingredient means "mass %".

C: 0.03 to 0.10%

C may be an important ingredient for securing the strength. If the C content is less than 0.03%, it may be difficult to obtain sufficient strength, for example, a strength of 540 MPa or more. On the other hand, if the C content exceeds 0.10%, the hard second phase and the like, such as cementite, may be excessively increased to deteriorate the hole expandability. For this reason, the C content is specified to be from 0.03 to 0.10%. Incidentally, from the standpoint of securing the strength, the C content may be preferably 0.05% or more, more preferably 0.06% or more. Also, in order to suppress an excessive increase of the hard second phase and the like, such as cementite, as much as possible, the C content may be preferably 0.08% or less, more preferably 0.07% or less.

Si: 0.5 to 1.5%

Si may be an important element for more successfully securing the strength by solid solution strengthening. If the Si content is less than 0.5%, it may be difficult to obtain sufficient strength, for example, a strength of 540 MPa or more. On the other hand, if the Si content exceeds 1.5%, the hole expandability may deteriorate, because when Si is added in a large amount, the toughness may be reduced to cause brittle fracture before undergoing a large deformation. For this reason, the Si content is specified to be from 0.5 to 1.5%.

Incidentally, from the standpoint of securing the strength, the Si content may be preferably 0.7% or more, more preferably 0.8% or more. Also, from the standpoint of suppressing an excessive increase of the hard second phase and the like as much as possible, the Si content may be preferably 1.4% or less, more preferably 1.3% or less.

Mn: 0.5 to 2.0%

Mn may be an important element for ensuring the quenchability. If the Mn content is less than 0.5%, bainite cannot be adequately produced and it may be difficult to obtain sufficient strength, for example, a strength of 540 MPa or more. Because, Mn is an austenite former and may have an effect of suppressing ferrite transformation, that is, if the Mn content is small, ferrite transformation may excessively proceed, failing in obtaining bainite.

On the other hand, if the Mn content exceeds 2.0%, transformation may be extremely delayed, making it difficult to produce ferrite, and ductility may deteriorate. Because, Mn that is an austenite former may have an effect of lowering the Ae3 point. For this reason, the Mn content is specified to be from 0.5 to 2.0%. Furthermore, the Mn content may be preferably 1.0% or more and preferably 1.6% or less.

Al: 0.30% or Less

Al may function as a deoxidizing element, but if the Al content exceeds 0.3%, many inclusions such as alumina may be formed and the hole expandability and stretch flanging workability may deteriorate. Al may be an element that is desired to be eliminated, and even when this element is unavoidably contained, the Al content is limited to 0.3% or less. The content may be preferably limited to 0.15% or less, more preferably to 0.10% or less. The lower limit of the Al content may not be particularly specified, but it may be technologically difficult to reduce the content to less than 0.0005%.

P: 0.05% or Less

P may be an impurity element, and if the P content exceeds 0.05%, in the case of applying welding to the hot-rolled steel sheet, embrittlement of the welded part may become conspicuous. Accordingly, the P content may be preferably as low as possible and is limited to 0.05% or less. The content may be preferably limited to 0.01% or less. Incidentally, the lower limit of the P content may not be particularly specified, but reducing the content to less than 0.0001% by a dephosphorization (P) step or the like may be economically disadvantageous.

S: 0.01% or Less

S may be an impurity element, and if the S content exceeds 0.01%, an adverse effect on the weldability may become conspicuous. Accordingly, the S content may be preferably as low as possible and is limited to 0.01% or less. The content may be preferably limited to 0.005% or less. If S is excessively contained, coarse MnS may be formed and the hole expandability and stretch flanging workability may be liable to deteriorate. Incidentally, the lower limit of the S content may not be particularly specified, but reducing the content to less than 0.0001% by a desulfurization (S) step or the like may be economically disadvantageous.

N: 0.01% or Less

N may be an impurity element and if the N content exceeds 0.01%, coarse nitride may be formed and the hole expandability and stretch flanging workability may deteriorate. Accordingly, the N content may be preferably as low as possible and is limited to 0.01% or less. The content may be preferably limited to 0.005% or less. As the N content is increased, a blow hole may be more likely to be formed at the welding. The lower limit of the N content may not be particularly specified, but when the content is reduced to less than 0.0005%, the production cost may significantly rise.

In the hot-rolled steel sheet of the present invention and the steel used for the production thereof, the balance is Fe. However, at least one element selected from Nb, Ti, V, W, Mo, Cu, Ni, Cr, B, Ca and REM (rare earth metal) may be contained.

Nb, Ti, V, W and Mo may be elements contributing to more increasing the strength. The lower limits of the contents of these elements are not particularly specified, but for effectively increasing the strength, the Nb content may be preferably 0.005% or more, the Ti content may be preferably 0.02% or more, the V content may be preferably 0.02% or more, the W content may be preferably 0.1% or more, and the Mo content may be preferably 0.05% or more. On the other hand, for securing the moldability, the Nb content may be preferably 0.08% or less, the Ti content may be 0.2% or less, the V content may be preferably 0.2% or less, the W content may be preferably 0.5% or less, and the Mo content may be preferably 0.4% or less.

Cu, Ni, Cr and B may be also elements contributing to increasing the strength. The lower limits may not be particularly specified, but in order to obtain an effect of increasing the strength, it may be preferred to add Cu: 0.1% or more, Ni: 0.01%, Cr: 0.01%, and B: 0.0002% or more. However, the upper limits are Cu: 1.2%, Ni: 0.6%, Cr: 1.0%, and B: 0.005%, because excessive addition may deteriorate the moldability.

Ca and REM may be elements effective in controlling the morphologies of oxide and sulfide. The lower limits of contents of these elements may not be particularly specified, but in order to effectively perform the morphology control, both the Ca content and the REM content may be preferably 0.0005% or more. On the other hand, for securing moldability, both the Ca content and the REM content may be preferably 0.01% or less. Here, REM as used in the present invention indicates La and a lanthanoid series element. As REM, for example, a misch metal may be added at the steelmaking stage. The misch metal may contain La and an element of this series, such as Ce, in a composite form. It may be also possible to add metal La and/or metal Ce.

[Metal Texture]

The structure of the hot-rolled steel sheet according to the present invention may be described in detail below.

Area Fraction of Ferrite: 70% or More

Ferrite may be a very important structure for securing ductility. If the area fraction of ferrite is less than 70%, sufficiently high ductility may not be obtained. For this reason, the area fraction of ferrite is specified to be 70% or more and may be preferably 75% or more, still more preferably 80% or more. On the other hand, if the area fraction of ferrite exceeds 90%, bainite may lack, failing in securing the strength. Also, C enrichment into austenite may proceed, as a result, the strength of bainite may be excessively increased and the hole expandability may deteriorate. For this reason, the area fraction of ferrite may be preferably 90% or less, more preferably 88% or less, and the area fraction may be still more preferably 85% or less, because deterioration of the hole expandability may not occur.

Area Fraction of Bainite: 30% or Less

Bainite may be an important structure contributing to strengthening. If the area fraction of bainite is less than 5%, it may be difficult to obtain a sufficiently high tensile strength, for example, a tensile strength of 540 MPa or more. For this reason, the area fraction of bainite may be preferably 5% or more, more preferably 7% or more. On the other hand, if the area fraction of bainite exceeds 30%, the area fraction of ferrite may lack, failing in obtaining adequate ductility. Accordingly, the area fraction of bainite may be preferably 30% or less and from the standpoint of securing ductility by ferrite, the area fraction may be more preferably 27% or less, still more preferably 25% or less.

Area Fraction of MA (Martensite-Retained Austenite): 2% or Less

MA may be either one or both of martensite and retained austenite and can be observed, for example, as a white part in an optical microscopic image of a sample subjected to etching with a LePera reagent. Also, the inclusion may include an oxide, a sulfide and the like, such as MnS and $Al_2O_3$. These may contain, for example, an impurity ingredient or an ingredient added for deoxidization.

MA may be a structure that forms a void along with deformation to deteriorate the hole expandability. Accordingly, if the area fraction of MA exceeds 2%, such deterioration of hole expandability may become conspicuous. For this reason, the area fraction of MA is specified to be 2% or less. The area fraction of MA may be preferably smaller and may be preferably 1% or less, more preferably 0.5% or less.

Due to the structure control described above, a hot-rolled steel sheet with excellent press formability, which is high in all of ductility, hole expandability and side bend elongation, may be obtained. Accordingly, application of a high-strength steel sheet to automotive underbody components may be encouraged, and contribution to improvement of fuel consumption and reduction of carbon dioxide emission may be quite noticeable. Furthermore, by controlling the following texture, a hot-rolled steel sheet with excellent press formability, where the material anisotropy is small, may be obtained.

That is, in a steel having a predetermined ingredient composition, when the steel is produced to have a predetermined textural structure and have a void formation/connection index L in a predetermined range (in the present invention, 11.5 or more), a hot-rolled steel sheet excellent not only in the hole expandability but also in the stretch flanging workability can be produced.

The texture may be an important factor relevant to the material anisotropy. When there is a difference of 10% or more between the side bend elongation in the sheet width direction and that in the rolling direction, for example, a crack may be generated depending on the forming direction of an actual component. In the steel sheet, the X-ray random intensity ratios of {211} planes parallel to steel sheet surfaces (rolling surfaces) at the ½ thickness position, the ¼ thickness position and the ⅛ thickness position are specified to be 1.5 or less, 1.3 or less, and 1.1 or less, respectively, whereby the anisotropy of the side bend elongation can be reduced and the difference thereof can be made to be 10% or less. Here, the ½ thickness position, the ¼ thickness position and the ⅛ thickness position mean that the distance in the thickness direction from the surface of the hot-rolled steel sheet is located at the position of ½, the position of ¼, and the position of ⅛, respectively, of the thickness of the hot-rolled steel sheet. In the side bend test, the strain amount allowing a generated crack to penetrate in the sheet thickness direction may be measured. Accordingly, in order to decrease the anisotropy, it may be effective to reduce the X-ray random intensity ratios at all sheet thickness positions.

[Production Method]

The production method for a hot-rolled steel sheet of the present invention may be described below.

A slab (steel billet) may be obtained by performing ingot making and casting of a steel composed of the above-described ingredients. As the casting, continuous casting may be preferably performed in view of productivity. Subsequently, the slab may be reheated at a temperature of 1,150° C. or more, held for 120 minutes or more, and then hot-rolled. Reheating may be done because heating at a temperature of 1,150° C. or more for 120 minutes or more melts an inclusion such as MnS in the slab and an inclusion even when produced in the subsequent cooling process becomes fine. If the reheating temperature is less than 1,150° C. or the reheating time is less than 120 minutes, a coarse inclusion present in the slab may be not fully melted and many inclusions may remain, failing in obtaining high stretch flangeability. The upper limit of the reheating temperature may be not particularly specified, but in view of production cost, the temperature may be preferably 1,300° C. or less. The upper limit of the holding time of reheating may be also not particularly specified, but in view of the production cost, the holding time may be preferably 180 minutes or less. However, these may not apply when a slab cast by continuous casting is hot transferred and directly rolled. In this case, it may be sufficient when a temperature state of 1,150° C. or more including the temperature after continuous casting is continuously held for 120 minutes or more before rolling.

In the hot rolling, rough rolling and then finish rolling may be performed. At this time, the finish rolling may be preferably performed such that the end temperature (finish rolling temperature) becomes from $Ae_3-30°$ C. to $Ae_3+30°$ C. If the finish rolling temperature exceeds $Ae_3+30°$ C., an austenite grain after recrystallization may be coarsened, making it difficult to cause ferrite transformation. On the other hand, if the finish rolling temperature is less than $Ae_3-30°$ C., recrystallization may be significantly delayed and the anisotropy of side bend elongation may become large. In order to eliminate these concerns, the finish rolling may be preferably performed such that the end temperature becomes from $Ae_3-25°$ C. to $Ae_3+25°$ C., more preferably from $Ae_3-20°$ C. to $Ae_3+20°$ C. Incidentally, $Ae_3$ can be determined according to the following formula 2:

$$Ae_3=937-477C+56Si-20Mn-16Cu-15Ni-5Cr+38Mo+125V+136Ti-19Nb+198Al+3315B \quad \text{(formula 2)}$$

wherein C, Si, Mn, Cu, Ni, Cr, Mo, V, Ti, Nb, Al and B represent the contents (mass %) of respective elements.

Also, in the finish rolling, the total of pass-to-pass times in final 4 stands (in the case of a four-stand tandem rolling mill, the total of transit times between respective stands (three sections)) may be preferably 3 seconds or less. If the total pass-to-pass time exceeds 3 seconds, recrystallization may occur between passes and since the strain cannot be accumulated, the recrystallization rate after finish rolling may be reduced. As a result, the X-ray random intensity ratio of {211} plane may become high and the side bend anisotropy may be increased.

After the hot rolling, cooling of the rolled steel sheet may be performed in two stages. These cooling operations in two stages may be referred to as primary cooling and secondary cooling, respectively.

In the primary cooling, the cooling rate for the steel sheet is specified to be 50° C./s or more. If the cooling rate in the primary cooling is less than 50° C./s, a ferrite grain may grow large and the nucleation site of cementite may decrease, as a result, cementite may be coarsened, failing in obtaining a void formation/connection index L of 11.5 ($\mu m^{-1}$) or more. In order to more reliably prevent the coarsening of cementite, the lower limit of the cooling rate may be preferably 60° C./s or more, more preferably 70° C./s or more. The upper limit of the cooling rate in the primary cooling may be not particularly specified, but the upper limit may be preferably set to 300° C./s or less in the practical range.

The primary cooling may be preferably started between 1.0 seconds and 2.0 seconds after the completion of hot rolling. If the cooling is started before the elapse of 1.0 seconds, recrystallization may not proceed sufficiently, as a result, the random intensity ratio may become large and the anisotropy of side bend elongation may be increased. On the other hand, if the cooling is started after the elapse of 2.0 seconds, the y grain after recrystallization may be coarsened and therefore, the strength can be hardly secured. In order to more unfailingly achieve these effects, the lower limit of the elapse time after hot rolling to start of primary cooling may be preferably 1.2 seconds, more preferably 1.3 seconds, and the upper limit of the elapse time may be preferably 1.9 seconds, more preferably 1.8 seconds.

The primary cooling stop temperature is specified to be from 510 to 700° C. When the cooling is stopped at a temperature of more than 700° C., ferrite grain growth may proceed and the nucleation site of cementite may decrease, as a result, cementite may be coarsened, failing in obtaining a void formation/connection index L of 11.5 ($\mu m^{-1}$) or more. Also, sufficient side bend elongation may not be obtained.

For the fine formation of cementite or MA, the primary cooling stop temperature may be preferably as low as possible. For this reason, the primary cooling stop temperature may be preferably 650° C. or less, more preferably 620° C. or less. The stop temperature may be still more preferably 600° C. or less, because finer cementite or MA may be obtained.

On the other hand, if the cooling is stopped at a temperature of less than 510° C., ferrite transformation may not proceed and since the volume percentage of bainite may be increased, ductility may deteriorate. For the fine formation of cementite or MA, the primary cooling stop temperature may be preferably as low as possible but, in view of ferrite transformation ratio, the temperature cannot be too much low. For this reason, the lower limit of the primary cooling stop temperature may be preferably 520° C., more preferably 530° C. The primary cooling stop temperature may be still more preferably 550° C. or more, and in this case, ferrite transformation may proceed and the effect of subsequent air cooling may be obtained easily.

Between the primary cooling and the secondary cooling, air cooling for 2 to 5 seconds is performed. If the air cooling time is less than 2 seconds, ferrite transformation may not proceed sufficiently and adequate elongation may not be obtained. On the other hand, if the air cooling time exceeds 5 seconds, pearlite may be produced and bainite may not be obtained, leading to decrease in the strength. Here, air cooling means leaving to stand in the air, so-called radiational cooling, and the cooling rate may be approximately from 4 to 5° C./s.

Thereafter, secondary cooling is performed. The cooling rate in the secondary cooling is specified to be 30° C./s or more. If the cooling rate is less than 30° C./s, the growth of cementite may be promoted, and a void formation/connection index L of 11.5 ($\mu m^{-1}$) or more may not be obtained. In order to unfailingly prevent the growth of cementite, the cooling rate may be preferably 40° C./s or more, more preferably 50° C./s or more. The upper limit of the cooling rate in the secondary cooling may be not particularly specified, but the upper limit may be preferably set to 300° C./s or less in the practical range.

After the secondary cooling, the steel sheet may be wound into a coil form. Accordingly, the end temperature of secondary cooling may be almost the same as the coiling start temperature. The coiling start temperature can be set to be from 500 to 600° C. If the coiling start temperature exceeds 600° C., bainite may lack and sufficient strength cannot be secured. From the standpoint of eliminating these concerns, the upper limit of the coiling start temperature may be preferably 590° C., more preferably 580° C.

On the other hand, if the coiling start temperature is less than 500° C., bainite may become excessive and not only the hole expandability may deteriorate but also the stretch flanging workability ma be worsened. Furthermore, if the coiling start temperature is a low temperature of less than 500° C., production of acicular ferrite may be readily promoted. As described above, acicular ferrite may be likely to allow for production of a void working out to a starting point of a crack, which may lead to worsening of the stretch flangeability and reduction in the ductility. In order to eliminate these concerns, the coiling start temperature may be preferably 510° C., more preferably 520° C. or more, and when the temperature is 530° C. or more, production of acicular ferrite can be greatly suppressed.

The average cooling rate from the coiling start temperature until reaching 200° C. may be 30° C./h or more. If this average cooling late is less than 30° C./h, cementite may excessively grow, and a void formation/connection index L of 11.5 ($\mu m^{-1}$) or more may not be obtained. In turn, adequate side bend elongation may not be obtained. Incidentally, the method for controlling the cooling rate may not be particularly limited. For example, a coil obtained by coiling may be cooled directly with water. In addition, as the mass of the coil is larger, the cooling rate may be lower, and therefore, it may be also possible to reduce the mass of the coil and thereby increase the cooling rate.

While the invention has bee described in detail in the foregoing pages, the present invention may not be limited to these embodiments. Any embodiment may be employed without limitation as long as it has the technical characteristics of the present invention.

Also, the production line may have its inherent characteristics and therefore, in the production method, minor adjustments may be made in the characteristics inherent in the production line based on the above-described production method so that the void formation/connection index L proposed in the present invention can fall in the predetermined range (in the present invention, 11.5 or more).

EXAMPLES

Examples performed by the present inventors may be described below. In these Examples, the conditions and the like may be an example employed for verifying the practicability and effects of the present invention, and the present invention may not be limited thereto.

First, a slab (Steels A to R) was produced by casting a steel having chemical ingredients shown in Table 1. Subsequently, the slab was hot-rolled under the conditions shown in Table 2 (Table 2 includes Table 2-1 and Table 2-2) to obtain a hot-rolled steel sheet (Test Nos. 1 to 40).

TABLE 1

| Ingredient | C | Si | Mn | P | S | Al | N | Nb | Ti | Mo | V | W | Cu |
|---|---|---|---|---|---|---|---|---|---|---|---|---|---|
| A | 0.029 | 0.95 | 1.45 | 0.02 | 0.002 | 0.03 | 0.004 | 0 | 0 | 0 | 0 | 0 | 0 |
| B | 0.12 | 1 | 1.45 | 0.02 | 0.002 | 0.02 | 0.003 | 0 | 0 | 0 | 0 | 0 | 0 |
| C | 0.06 | 0.4 | 1.4 | 0.03 | 0.004 | 0.02 | 0.004 | 0 | 0 | 0 | 0 | 0 | 0 |
| D | 0.06 | 1.6 | 1.3 | 0.03 | 0.002 | 0.03 | 0.003 | 0 | 0 | 0 | 0 | 0 | 0 |
| E | 0.06 | 1.2 | 0.45 | 0.02 | 0.004 | 0.03 | 0.003 | 0 | 0 | 0 | 0 | 0 | 0 |
| F | 0.06 | 1.1 | 2.1 | 0.03 | 0.004 | 0.03 | 0.003 | 0 | 0 | 0 | 0 | 0 | 0 |
| G | 0.065 | 1.2 | 1.45 | 0.02 | 0.004 | 0.03 | 0.004 | 0 | 0 | 0 | 0 | 0 | 0 |
| H | 0.07 | 1.25 | 1.4 | 0.03 | 0.004 | 0.03 | 0.003 | 0 | 0 | 0 | 0 | 0 | 0 |
| I | 0.075 | 1.25 | 1.8 | 0.02 | 0.004 | 0.02 | 0.002 | 0 | 0 | 0 | 0 | 0 | 0 |
| J | 0.085 | 1.25 | 1.1 | 0.03 | 0.004 | 0.03 | 0.004 | 0 | 0 | 0 | 0 | 0 | 0 |
| K | 0.09 | 1.25 | 1.3 | 0.04 | 0.002 | 0.02 | 0.002 | 0 | 0 | 0 | 0 | 0 | 0 |
| L | 0.058 | 1.05 | 1.3 | 0.03 | 0.004 | 0.03 | 0.002 | 0.02 | 0 | 0 | 0 | 0 | 0 |
| M | 0.063 | 1.05 | 1.3 | 0.03 | 0.004 | 0.02 | 0.002 | 0 | 0.08 | 0 | 0 | 0 | 0 |
| N | 0.059 | 1.05 | 1.3 | 0.02 | 0.004 | 0.03 | 0.004 | 0 | 0 | 0.2 | 0 | 0 | 0 |
| O | 0.063 | 1.05 | 1.3 | 0.03 | 0.002 | 0.02 | 0.004 | 0 | 0 | 0 | 0.2 | 0 | 0 |
| P | 0.057 | 1.05 | 1.3 | 0.03 | 0.003 | 0.02 | 0.002 | 0 | 0 | 0 | 0 | 0.2 | 0 |
| Q | 0.059 | 1.05 | 1.3 | 0.02 | 0.003 | 0.02 | 0.004 | 0 | 0 | 0 | 0 | 0 | 0 |
| R | 0.061 | 1.05 | 1.3 | 0.04 | 0.004 | 0.03 | 0.003 | 0 | 0 | 0 | 0 | 0 | 0 |
| S | 0.059 | 1.05 | 1.3 | 0.03 | 0.003 | 0.02 | 0.004 | 0.01 | 0.06 | 0 | 0 | 0 | 0 |
| T | 0.033 | 1 | 0.6 | 0.02 | 0.003 | 0.02 | 0.004 | 0.01 | 0 | 0 | 0 | 0 | 0.6 |
| U | 0.045 | 0.6 | 1.2 | 0.03 | 0.003 | 0.03 | 0.004 | 0.02 | 0.04 | 0 | 0 | 0 | 0.4 |
| V | 0.063 | 1 | 1.2 | 0.03 | 0.004 | 0.03 | 0.003 | 0 | 0.05 | 0 | 0 | 0 | 0 |
| W | 0.055 | 1.05 | 1.2 | 0.02 | 0.004 | 0.02 | 0.002 | 0 | 0 | 0.1 | 0 | 0 | 0.2 |

| Ingredient | Ni | Cr | B | Ca | REM | Ae3 | Ae3 − 30 | Ae3 + 30 | Remarks |
|---|---|---|---|---|---|---|---|---|---|
| A | 0 | 0 | 0 | 0 | 0 | 953 | 923 | 983 | Comparative |
| B | 0 | 0 | 0 | 0 | 0 | 911 | 881 | 941 | Example |
| C | 0 | 0 | 0 | 0 | 0 | 907 | 877 | 937 | |
| D | 0 | 0 | 0 | 0 | 0 | 978 | 948 | 1008 | |
| E | 0 | 0 | 0 | 0 | 0 | 973 | 943 | 1003 | |
| F | 0 | 0 | 0 | 0 | 0 | 934 | 904 | 964 | |
| G | 0 | 0 | 0 | 0 | 0 | 950 | 920 | 980 | Invention |
| H | 0 | 0 | 0 | 0 | 0 | 952 | 922 | 982 | |
| I | 0 | 0 | 0 | 0 | 0 | 939 | 909 | 969 | |
| J | 0 | 0 | 0 | 0 | 0 | 950 | 920 | 980 | |
| K | 0 | 0 | 0 | 0 | 0 | 942 | 912 | 972 | |
| L | 0 | 0 | 0 | 0 | 0 | 948 | 918 | 978 | |
| M | 0 | 0 | 0 | 0 | 0 | 955 | 925 | 985 | |
| N | 0 | 0 | 0 | 0 | 0 | 955 | 925 | 985 | |
| O | 0 | 0 | 0 | 0 | 0 | 969 | 939 | 999 | |
| P | 0 | 0 | 0 | 0 | 0 | 947 | 917 | 977 | |
| Q | 0 | 0 | 0 | 0.005 | 0 | 946 | 916 | 976 | |
| R | 0 | 0 | 0 | 0 | 0.005 | 947 | 917 | 977 | |
| S | 0 | 0 | 0 | 0.004 | 0.007 | 954 | 924 | 984 | |
| T | 0.3 | 0 | 0 | 0 | 0 | 955 | 925 | 985 | |
| U | 0.2 | 0.5 | 0 | 0 | 0 | 924 | 894 | 954 | |
| V | 0 | 0.3 | 0 | 0.003 | 0.004 | 950 | 920 | 980 | |
| W | 0.1 | 0.3 | 0.001 | 0 | 0 | 950 | 920 | 980 | |

Comp. Ex.: Comparative Example (hereinafter the same)

TABLE 2-1

| Test No. | Steel | SRT | Heating Time | Total Pass-to-Pass Time | End Temperature of Finish Rolling | Time Until Start of Primary Cooling | Primary Cooling Rate | Primary Cooling Stop Temperature | Air Cooling Time | Secondary Cooling Rate | Coiling Temperature | Cooling Rate from CT to 200° C. | Remarks |
|---|---|---|---|---|---|---|---|---|---|---|---|---|---|
| 1 | A | 1200 | 123 | 2.1 | 966 | 1.8 | 57 | 647 | 2 | 43 | 583 | 43 | Comp. Ex. |
| 2 | B | 1250 | 130 | 2.6 | 939 | 2 | 65 | 543 | 4 | 44 | 513 | 48 | Comp. Ex. |
| 3 | C | 1150 | 143 | 2.36 | 917 | 1.6 | 59 | 596 | 4 | 37 | 564 | 46 | Comp. Ex. |
| 4 | D | 1150 | 150 | 2.5 | 992 | 1.6 | 57 | 623 | 5 | 35 | 579 | 49 | Comp. Ex. |
| 5 | E | 1150 | 136 | 2.22 | 949 | 1.9 | 65 | 618 | 2 | 39 | 537 | 30 | Comp. Ex. |
| 6 | F | 1200 | 145 | 2.28 | 906 | 1.5 | 62 | 658 | 3 | 44 | 514 | 46 | Comp. Ex. |
| 7 | G | 1140 | 144 | 2.24 | 972 | 1.9 | 62 | 610 | 2 | 33 | 579 | 40 | Comp. Ex. |
| 8 | G | 1250 | 123 | 2.79 | 941 | 0.9 | 59 | 618 | 3 | 31 | 581 | 37 | Invention |
| 9 | G | 1250 | 146 | 2.15 | 955 | 1.5 | 56 | 640 | 4 | 35 | 565 | 48 | Invention |
| 10 | G | 1150 | 126 | 2.48 | 944 | 2 | 51 | 611 | 5 | 40 | 552 | 35 | Invention |
| 11 | H | 1200 | 130 | 2.6 | 963 | 1.6 | 62 | 670 | 4 | 34 | 509 | 36 | Invention |
| 12 | H | 1250 | 133 | 3.1 | 977 | 1.9 | 62 | 678 | 2 | 38 | 540 | 36 | Invention |
| 13 | H | 1200 | 127 | 2.56 | 961 | 1.7 | 54 | 611 | 5 | 31 | 553 | 38 | Invention |
| 14 | H | 1250 | 123 | 1.91 | 939 | 1.5 | 59 | 514 | 2 | 34 | 500 | 34 | Invention |
| 15 | H | 1250 | 130 | 2.28 | 979 | 1.5 | 58 | 626 | 4 | 36 | 598 | 49 | Invention |

TABLE 2-1-continued

| Test No. | Steel | SRT | Heating Time | Total Pass-to-Pass Time | End Temperature of Finish Rolling | Time Until Start of Primary Cooling | Primary Cooling Rate | Primary Cooling Stop Temperature | Air Cooling Time | Secondary Cooling Rate | Coiling Temperature | Cooling Rate from CT to 200° C. | Remarks |
|---|---|---|---|---|---|---|---|---|---|---|---|---|---|
| 16 | H | 1220 | 140 | 2.23 | 977 | 1.4 | 62 | 588 | 3 | 25 | 510 | 35 | Comp. Ex. |
| 17 | I | 1220 | 100 | 2.74 | 955 | 1.6 | 58 | 610 | 5 | 44 | 581 | 34 | Comp. Ex. |
| 18 | I | 1150 | 150 | 2.35 | 900 | 2 | 61 | 605 | 2 | 45 | 588 | 34 | Invention |
| 19 | I | 1200 | 135 | 2.79 | 975 | 1.7 | 55 | 606 | 4 | 44 | 559 | 44 | Comp. Ex. |
| 20 | I | 1200 | 125 | 2.85 | 941 | 1.5 | 43 | 582 | 3 | 32 | 543 | 39 | Comp. Ex. |
| 21 | I | 1200 | 128 | 2.36 | 933 | 1.7 | 65 | 489 | 2 | 44 | 450 | 30 | Comp. Ex. |
| 22 | I | 1200 | 137 | 2.06 | 932 | 2 | 63 | 708 | 3 | 39 | 536 | 40 | Comp. Ex. |
| 23 | I | 1200 | 147 | 2.69 | 943 | 1.8 | 59 | 641 | 1 | 31 | 584 | 49 | Comp. Ex. |
| 24 | I | 1200 | 120 | 2.38 | 940 | 1.5 | 61 | 656 | 6 | 42 | 532 | 43 | Comp. Ex. |
| 25 | I | 1200 | 123 | 2.89 | 938 | 2 | 64 | 585 | 5 | 43 | 480 | 45 | Comp. Ex. |

TABLE 2-2

| Test No. | Steel | SRT | Heating Time | Total Pass-to-Pass Time | End Temperature of Finish Rolling | Time Until Start of Primary Cooling | Primary Cooling Rate | Primary Cooling Stop Temperature | Air Cooling Time | Secondary Cooling Rate | Coiling Temperature | Cooling Rate from CT to 200° C. | Remarks |
|---|---|---|---|---|---|---|---|---|---|---|---|---|---|
| 26 | I | 1200 | 135 | 2.15 | 952 | 1.5 | 65 | 661 | 5 | 40 | 630 | 31 | Comp. Ex. |
| 27 | I | 1200 | 126 | 2.61 | 928 | 1.7 | 65 | 544 | 4 | 43 | 521 | 25 | Comp. Ex. |
| 28 | I | 1200 | 125 | 2.42 | 946 | 1.7 | 57 | 612 | 5 | 39 | 500 | 41 | Invention |
| 29 | I | 1200 | 129 | 2.65 | 965 | 1.8 | 61 | 561 | 3 | 41 | 529 | 41 | Invention |
| 30 | I | 1200 | 128 | 2.75 | 923 | 1.9 | 51 | 598 | 4 | 32 | 574 | 46 | Invention |
| 31 | I | 1200 | 127 | 2.16 | 938 | 1.5 | 54 | 640 | 2 | 45 | 599 | 47 | Invention |
| 32 | J | 1200 | 121 | 2.59 | 948 | 1.5 | 58 | 566 | 4 | 44 | 545 | 48 | Invention |
| 33 | K | 1200 | 145 | 2.48 | 953 | 1.7 | 54 | 532 | 2 | 35 | 512 | 50 | Invention |
| 34 | L | 1200 | 130 | 2.17 | 928 | 1.9 | 52 | 581 | 3 | 40 | 559 | 37 | Invention |
| 35 | M | 1200 | 137 | 2.23 | 962 | 1.7 | 52 | 514 | 2 | 43 | 500 | 38 | Invention |
| 36 | N | 1200 | 131 | 2.1 | 979 | 1.6 | 59 | 543 | 3 | 39 | 526 | 38 | Invention |
| 37 | O | 1200 | 135 | 2.26 | 943 | 1.9 | 50 | 596 | 3 | 41 | 574 | 47 | Invention |
| 38 | P | 1200 | 148 | 2.43 | 975 | 1.5 | 54 | 533 | 4 | 33 | 512 | 44 | Invention |
| 39 | Q | 1200 | 130 | 2.55 | 972 | 1.9 | 62 | 618 | 3 | 31 | 579 | 47 | Invention |
| 40 | R | 1200 | 137 | 2.42 | 972 | 1.7 | 57 | 658 | 4 | 35 | 578 | 35 | Invention |
| 41 | S | 1200 | 135 | 2.88 | 926 | 1.9 | 55 | 640 | 3 | 34 | 566 | 41 | Invention |
| 42 | T | 1200 | 123 | 2.1 | 983 | 1.6 | 51 | 683 | 4 | 35 | 574 | 37 | Invention |
| 43 | U | 1200 | 130 | 2.16 | 932 | 1.8 | 55 | 644 | 4 | 38 | 577 | 38 | Invention |
| 44 | V | 1200 | 121 | 2.1 | 952 | 1.6 | 56 | 632 | 4 | 39 | 597 | 33 | Invention |
| 45 | W | 1200 | 123 | 2.45 | 942 | 1.9 | 54 | 649 | 4 | 40 | 589 | 38 | Invention |
| 46 | W | 1200 | 125 | 2.48 | 935 | 1.7 | 47 | 618 | 4 | 34 | 598 | 33 | Comp. Ex. |
| 47 | W | 1200 | 130 | 2.17 | 944 | 1.7 | 52 | 616 | 4 | 44 | 581 | 27 | Comp. Ex. |
| 48 | W | 1200 | 123 | 2.69 | 968 | 1.8 | 46 | 640 | 4 | 44 | 598 | 48 | Comp. Ex. |
| 49 | W | 1200 | 122 | 2.69 | 929 | 2 | 58 | 614 | 4 | 31 | 589 | 25 | Comp. Ex. |

A sample was collected from each hot-rolled steel sheet, and the cross-section of the sheet thickness in the rolling direction, which was taken as the observation surface, was polished and then subjected to etching by various reagents to observe the metallic structure, whereby evaluations of MA, cementite (carbide) and an inclusion were preformed. The results obtained are shown in Table 3 (Table 3 includes Table 3-1 and Table 3-2).

The area fraction of ferrite and the area fraction of pearlite were measured by an optical micrograph at the ¼ thickness position of the sample etched by Nital reagent. The area fraction ($f_{MA}$), average diameter ($D_{MA}$) and number density ($n_{MA}$) of MA were measured by image analysis of an optical micrograph at the magnification of 500 time at the ¼ thickness position of the sample etched by LePera reagent. At this time, the measurement visual field was set to 40,000 $\mu m^2$ or more, and MA having an area of 0.1 $\mu m^2$ or more was taken as the measuring object. The area fraction of the remaining structure except for ferrite, pearlite and MA was used as the area fraction of bainite.

The area fraction ($f_\theta$), average diameter ($D_\theta$) and number density ($n_\theta$) of cementite were measured by image analysis of an optical micrograph at the magnification of 1,000 time at the ¼ thickness position of the sample etched by picral reagent. The measurement visual field was set to 10,000 $\mu m^2$ or more, and measurement of two or more visual fields was performed per one sample. Cementite having an area of 0.1 $\mu m^2$ or more was taken as the measuring object.

The area fraction ($f_i$), average diameter ($D_i$) and number density ($n_i$) of an inclusion were measured by particle analysis (particle finder method) in the region of 1.0 mm×2.0 mm at the ¼ thickness position of the cross-section of sheet thickness in the rolling direction. At this time, an inclusion having an area of 0.05 $\mu m^2$ or more was taken as the measuring object.

Incidentally, MA and cementite having area of 0.1 $\mu m^2$ or more were taken as the measuring object, because, as described above, MA and cementite smaller than that may not greatly affect the side bend elongation. On the other hand, an inclusion having an area of 0.05 $\mu m^2$ or more was taken as the measuring object, because an inclusion may more readily form a void than MA and cementite and affect the side bend elongation.

The void formation/connection index was calculated according to formula 1 and formula 2.

TABLE 3-1

| Test No. | Steel | Structure: MA: Average Interval $L_{MA}$ (μm) | MA: Average Diameter $D_{MA}$ (μm) | MA: Number Density $n_{MA}$ (/100 μm$^2$) | MA: Area Fraction $f_{MA}$ (%) | Cementite: Average Interval $L_\theta$ (μm) | Cementite: Average Diameter $D_\theta$ (μm) | Cementite: Number Density $n_\theta$ (/100 μm$^2$) | Cementite: Area Fraction $f_\theta$ (%) | Inclusion: Average Interval $L_i$ (μm) | Inclusion: Average Diameter $D_i$ (μm) | Inclusion: Number Density $n_i$ (/100 μm$^2$) | Inclusion: Area Fraction $f_i$ (%) | Remarks |
|---|---|---|---|---|---|---|---|---|---|---|---|---|---|---|
| 1 | A | 19.5 | 1.8 | 0.47 | 0.6 | 6.3 | 0.87 | 3.92 | 1.27 | 59.1 | 0.75 | 0.0584 | 0.013 | Comp. Ex. |
| 2 | B | 14.1 | 1.9 | 0.53 | 1.2 | 4.9 | 0.78 | 3.97 | 1.62 | 61.7 | 0.59 | 0.0539 | 0.007 | Comp. Ex. |
| 3 | C | 13.3 | 1.7 | 0.97 | 1.1 | 4.3 | 0.76 | 4.10 | 1.93 | 61.5 | 0.71 | 0.0541 | 0.011 | Comp. Ex. |
| 4 | D | 13.2 | 1.6 | 1.00 | 1 | 5.7 | 0.89 | 3.91 | 1.58 | 61.1 | 0.67 | 0.0548 | 0.010 | Comp. Ex. |
| 5 | E | 25.1 | 1.6 | 0.30 | 0.3 | 4.5 | 0.68 | 4.04 | 1.49 | 58.2 | 0.7 | 0.0586 | 0.012 | Comp. Ex. |
| 6 | F | 26.7 | 1.7 | 0.12 | 0.3 | 4.6 | 0.77 | 4.01 | 1.75 | 58.6 | 0.63 | 0.0597 | 0.009 | Comp. Ex. |
| 7 | G | 15.7 | 1.8 | 0.43 | 0.9 | 4.6 | 0.69 | 4.10 | 1.45 | 68.8 | 0.91 | 0.0586 | 0.014 | Comp. Ex. |
| 8 | G | 22.9 | 1.7 | 0.35 | 0.4 | 4.4 | 0.68 | 3.92 | 1.55 | 64.1 | 0.75 | 0.059 | 0.011 | Invention |
| 9 | G | 13.4 | 1.8 | 0.94 | 1.2 | 5.5 | 0.75 | 4.03 | 1.23 | 48.3 | 0.62 | 0.0582 | 0.013 | Invention |
| 10 | G | 13.9 | 1.6 | 0.90 | 0.9 | 4.9 | 0.72 | 3.95 | 1.41 | 61.8 | 0.69 | 0.0585 | 0.010 | Invention |
| 11 | H | 19.0 | 1.9 | 0.29 | 0.7 | 4.9 | 0.73 | 4.01 | 1.44 | 62.1 | 0.62 | 0.0532 | 0.008 | Invention |
| 12 | H | 19.0 | 1.9 | 0.34 | 0.7 | 4.5 | 0.71 | 4.06 | 1.59 | 60.2 | 0.6 | 0.0554 | 0.008 | Invention |
| 13 | H | 22.7 | 1.9 | 0.20 | 0.5 | 5.7 | 0.8 | 3.96 | 1.30 | 58.8 | 0.71 | 0.059 | 0.012 | Invention |
| 14 | H | 25.1 | 1.6 | 0.24 | 0.3 | 5.0 | 0.75 | 3.95 | 1.44 | 55.0 | 0.65 | 0.0583 | 0.011 | Invention |
| 15 | H | 13.5 | 1.9 | 0.58 | 1.3 | 4.7 | 0.73 | 4.06 | 1.57 | 62.5 | 0.59 | 0.0525 | 0.007 | Invention |
| 16 | H | 15.7 | 1.8 | 0.50 | 0.9 | 5.3 | 0.8 | 4.00 | 1.50 | 62.0 | 0.79 | 0.05 | 0.013 | Comp. Ex. |
| 17 | I | 13.5 | 1.9 | 0.63 | 1.3 | 4.8 | 0.81 | 4.01 | 1.78 | 83.2 | 0.85 | 0.385 | 0.008 | Comp. Ex. |
| 18 | I | 11.7 | 1.5 | 0.58 | 1.1 | 5.3 | 0.78 | 4.05 | 1.39 | 65.2 | 0.69 | 0.0587 | 0.009 | Invention |
| 19 | I | 20.4 | 1.7 | 0.44 | 0.5 | 5.2 | 0.82 | 3.93 | 1.59 | 61.0 | 0.61 | 0.0551 | 0.008 | Comp. Ex. |
| 20 | I | 18.5 | 1.7 | 0.53 | 0.6 | 4.5 | 0.77 | 3.96 | 1.87 | 59.9 | 0.69 | 0.0569 | 0.011 | Comp. Ex. |
| 21 | I | 25.6 | 1.9 | 0.25 | 0.4 | 5.7 | 0.81 | 3.97 | 1.32 | 63.2 | 0.72 | 0.0512 | 0.010 | Comp. Ex. |
| 22 | I | 28.2 | 1.8 | 0.75 | 0.3 | 5.6 | 0.83 | 4.07 | 1.45 | 55.5 | 0.65 | 0.0587 | 0.011 | Comp. Ex. |
| 23 | I | 18.5 | 1.7 | 0.53 | 0.6 | 4.3 | 0.73 | 4.05 | 1.81 | 63.5 | 0.68 | 0.0507 | 0.009 | Comp. Ex. |
| 24 | I | 13.1 | 1.5 | 0.80 | 0.9 | 5.1 | 0.79 | 3.80 | 1.55 | 66.2 | 0.66 | 0.0565 | 0.008 | Comp. Ex. |
| 25 | I | 13.5 | 1.9 | 0.53 | 1.3 | 6.5 | 0.83 | 3.93 | 1.08 | 61.2 | 0.73 | 0.0545 | 0.011 | Comp. Ex. |

| Test No. | Structure: Area Fraction of Ferrite (%) | Structure: Area Fraction of Bainite (%) | Structure: Area Fraction of Pearlite (%) | Structure: Void formation/Connection Index L | X-Ray Random Intensity Ratio of {211} Plane: ½ Thickness Position | X-Ray Random Intensity Ratio of {211} Plane: ¼ Thickness Position | X-Ray Random Intensity Ratio of {211} Plane: ⅛ Thickness Position | Remarks |
|---|---|---|---|---|---|---|---|---|
| 1 | 96.0 | 3.4 | 0.0 | 10.8 | 1.45 | 1.19 | 1.06 | Comp. Ex. |
| 2 | 67.0 | 31.8 | 0.0 | 11.9 | 1.33 | 1.27 | 1.02 | Comp. Ex. |
| 3 | 89.0 | 9.9 | 0.0 | 9.6 | 1.43 | 1.26 | 1.06 | Comp. Ex. |
| 4 | 81.0 | 18.0 | 0.0 | 9.8 | 1.38 | 1.24 | 1.04 | Comp. Ex. |
| 5 | 96.0 | 3.7 | 0.0 | 12.9 | 1.36 | 1.27 | 1.02 | Comp. Ex. |
| 6 | 65.0 | 34.7 | 0.0 | 12.2 | 1.4 | 1.19 | 1.06 | Comp. Ex. |
| 7 | 85.0 | 14.1 | 0.0 | 11.3 | 1.45 | 1.25 | 1.01 | Comp. Ex. |
| 8 | 94.0 | 5.6 | 0.0 | 12.5 | 1.55 | 1.21 | 1.03 | Invention |
| 9 | 93.6 | 5.2 | 0.0 | 11.7 | 1.38 | 1.21 | 1.04 | Invention |
| 10 | 81.0 | 18.1 | 0.0 | 11.9 | 1.38 | 1.23 | 1.01 | Invention |
| 11 | 89.0 | 10.3 | 0.0 | 13.0 | 1.4 | 1.18 | 1.02 | Invention |
| 12 | 86.0 | 13.3 | 0.0 | 12.9 | 1.52 | 1.27 | 1.06 | Invention |
| 13 | 87.0 | 12.5 | 0.0 | 12.1 | 1.39 | 1.16 | 1.04 | Invention |
| 14 | 84.0 | 15.7 | 0.0 | 12.6 | 1.41 | 1.13 | 1.05 | Invention |
| 15 | 93.0 | 5.7 | 0.0 | 12.3 | 1.41 | 1.27 | 1.02 | Invention |
| 16 | 93.0 | 6.1 | 0.0 | 10.0 | 1.38 | 1.25 | 1.08 | Comp. Ex. |
| 17 | 87.0 | 11.7 | 0.0 | 8.8 | 1.44 | 1.19 | 1.05 | Comp. Ex. |
| 18 | 88.0 | 10.9 | 0.0 | 11.8 | 1.6 | 1.4 | 1.2 | Invention |
| 19 | 67.0 | 32.5 | 0.0 | 11.9 | 1.46 | 1.13 | 1.03 | Comp. Ex. |
| 20 | 79.0 | 20.4 | 0.0 | 10.6 | 1.47 | 1.1 | 1.04 | Comp. Ex. |
| 21 | 65.0 | 34.6 | 0.0 | 11.6 | 1.33 | 1.3 | 1.04 | Comp. Ex. |
| 22 | 91.7 | 8.0 | 0.0 | 11.4 | 1.42 | 1.16 | 1.04 | Comp. Ex. |
| 23 | 65.0 | 34.4 | 0.0 | 11.0 | 1.49 | 1.3 | 1.02 | Comp. Ex. |
| 24 | 91.1 | 0.0 | 8.0 | 11.5 | 1.42 | 1.19 | 1.04 | Comp. Ex. |
| 25 | 68.0 | 30.7 | 0.0 | 11.6 | 1.46 | 1.25 | 1.02 | Comp. Ex. |

TABLE 3-2

| Test No. | Steel | Structure: MA: Average Interval $L_{MA}$ (μm) | MA: Average Diameter $D_{MA}$ (μm) | MA: Number Density $n_{MA}$ (/100 μm$^2$) | MA: Area Fraction $f_{MA}$ (%) | Cementite: Average Interval $L_\theta$ (μm) | Cementite: Average Diameter $D_\theta$ (μm) | Cementite: Number Density $n_\theta$ (/100 μm$^2$) | Cementite: Area Fraction $f_\theta$ (%) | Inclusion: Average Interval $L_i$ (μm) | Inclusion: Average Diameter $D_i$ (μm) | Inclusion: Number Density $n_i$ (/100 μm$^2$) | Inclusion: Area Fraction $f_i$ (%) | Remarks |
|---|---|---|---|---|---|---|---|---|---|---|---|---|---|---|
| 26 | I | 12.5 | 1.6 | 1.09 | 1.1 | 4.4 | 0.71 | 4.10 | 1.68 | 61.8 | 0.75 | 0.0535 | 0.012 | Comp. Ex. |
| 27 | I | 15.6 | 1.9 | 0.58 | 1 | 4.6 | 0.76 | 4.05 | 1.73 | 63.1 | 0.65 | 0.0514 | 0.009 | Comp. Ex. |
| 28 | I | 20.6 | 1.9 | 0.32 | 0.6 | 4.7 | 0.71 | 4.04 | 1.49 | 59.9 | 0.74 | 0.057 | 0.012 | Invention |
| 29 | I | 17.7 | 1.9 | 0.39 | 0.8 | 4.8 | 0.74 | 4.09 | 1.56 | 54.6 | 0.6 | 0.0534 | 0.010 | Invention |
| 30 | I | 29.8 | 1.9 | 0.17 | 0.3 | 4.8 | 0.75 | 4.04 | 1.55 | 59.4 | 0.6 | 0.058 | 0.008 | Invention |
| 31 | I | 29.8 | 1.9 | 0.13 | 0.3 | 4.9 | 0.73 | 4.06 | 1.42 | 59.9 | 0.72 | 0.057 | 0.012 | Invention |
| 32 | J | 15.6 | 1.3 | 0.31 | 0.5 | 5.0 | 0.71 | 4.06 | 1.33 | 58.2 | 0.65 | 0.0528 | 0.010 | Invention |
| 33 | K | 25.1 | 1.6 | 0.30 | 0.3 | 4.2 | 0.66 | 3.91 | 1.60 | 57.1 | 0.71 | 0.0592 | 0.012 | Invention |
| 34 | L | 10.9 | 1.4 | 0.60 | 1.1 | 5.1 | 0.8 | 3.70 | 1.59 | 58.6 | 0.62 | 0.0587 | 0.009 | Invention |
| 35 | M | 16.7 | 1.8 | 0.24 | 0.8 | 4.4 | 0.7 | 3.82 | 1.61 | 60.0 | 0.6 | 0.0551 | 0.008 | Invention |
| 36 | N | 10.0 | 1.4 | 0.65 | 1.3 | 4.6 | 0.69 | 3.93 | 1.45 | 59.9 | 0.69 | 0.0569 | 0.011 | Invention |
| 37 | O | 17.0 | 1.7 | 0.50 | 0.7 | 4.6 | 0.73 | 3.78 | 1.63 | 57.6 | 0.61 | 0.0512 | 0.009 | Invention |
| 38 | P | 13.2 | 1.6 | 0.63 | 1 | 4.6 | 0.71 | 4.06 | 1.55 | 50.4 | 0.59 | 0.0587 | 0.011 | Invention |
| 39 | Q | 11.2 | 1.5 | 0.58 | 1.2 | 4.0 | 0.65 | 3.87 | 1.67 | 64.5 | 0.69 | 0.057 | 0.009 | Invention |
| 40 | R | 13.9 | 1.6 | 0.44 | 0.9 | 4.6 | 0.71 | 3.85 | 1.56 | 74.0 | 0.74 | 0.0512 | 0.008 | Invention |
| 41 | S | 19.0 | 1.9 | 0.34 | 0.7 | 4.5 | 0.71 | 4.06 | 1.59 | 60.2 | 0.6 | 0.0554 | 0.008 | Invention |
| 42 | T | 17.7 | 1.9 | 0.55 | 0.8 | 5.2 | 0.77 | 3.59 | 1.43 | 50.7 | 0.62 | 0.053 | 0.012 | Invention |
| 43 | U | 19.0 | 1.9 | 0.53 | 0.7 | 5.2 | 0.78 | 3.77 | 1.48 | 67.2 | 0.67 | 0.0563 | 0.008 | Invention |
| 44 | V | 15.6 | 1.9 | 0.33 | 1 | 4.0 | 0.68 | 3.51 | 1.79 | 62.7 | 0.7 | 0.0537 | 0.01 | Invention |
| 45 | W | 21.5 | 1.8 | 0.20 | 0.5 | 4.1 | 0.62 | 3.77 | 1.51 | 66.2 | 0.7 | 0.0509 | 0.009 | Invention |
| 46 | W | 14.1 | 1.9 | 0.53 | 1.2 | 5.5 | 0.9 | 3.88 | 1.69 | 89.0 | 0.91 | 0.0415 | 0.008 | Comp. Ex. |
| 47 | W | 17.0 | 1.7 | 0.58 | 0.7 | 4.8 | 0.85 | 3.76 | 1.93 | 66.0 | 0.76 | 0.0622 | 0.011 | Comp. Ex. |
| 48 | W | 17.0 | 1.7 | 0.60 | 0.7 | 4.5 | 0.78 | 4.05 | 1.88 | 58.9 | 0.63 | 0.0555 | 0.009 | Comp. Ex. |
| 49 | W | 13.2 | 1.6 | 0.88 | 1 | 4.9 | 0.83 | 4.15 | 1.82 | 60.1 | 0.72 | 0.0565 | 0.011 | Comp. Ex. |

| Test No. | Structure: Area Fraction of Ferrite (%) | Area Fraction of Bainite (%) | Area Fraction of Pearlite (%) | Void formation/ Connection Index L | X-Ray Random Intensity Ratio of {211} Plane: ½ Thickness Position | ¼ Thickness Position | ⅛ Thickness Position | Remarks |
|---|---|---|---|---|---|---|---|---|
| 26 | 90.0 | 8.9 | 0.0 | 10.1 | 1.5 | 1.24 | 1.02 | Comp. Ex. |
| 27 | 76.0 | 23.0 | 0.0 | 10.9 | 1.38 | 1.11 | 1.04 | Comp. Ex. |
| 28 | 87.0 | 12.4 | 0.0 | 11.9 | 1.32 | 1.24 | 1.03 | Invention |
| 29 | 78.0 | 21.2 | 0.0 | 12.0 | 1.5 | 1.1 | 1.05 | Invention |
| 30 | 83.0 | 16.7 | 0.0 | 13.2 | 1.31 | 1.18 | 1.02 | Invention |
| 31 | 89.0 | 10.7 | 0.0 | 12.4 | 1.49 | 1.18 | 1.01 | Invention |
| 32 | 82.0 | 17.5 | 0.0 | 13.2 | 1.34 | 1.13 | 1.01 | Invention |
| 33 | 85.0 | 14.7 | 0.0 | 12.8 | 1.3 | 1.2 | 1.06 | Invention |
| 34 | 87.0 | 11.9 | 0.0 | 11.8 | 1.42 | 1.17 | 1.07 | Invention |
| 35 | 88.0 | 11.2 | 0.0 | 13.4 | 1.42 | 1.21 | 1.00 | Invention |
| 36 | 90.0 | 8.7 | 0.0 | 12.2 | 1.41 | 1.15 | 1.09 | Invention |
| 37 | 93.0 | 6.3 | 0.0 | 12.0 | 1.38 | 1.24 | 1.01 | Invention |
| 38 | 89.0 | 10.0 | 0.0 | 12.2 | 1.42 | 1.22 | 1.00 | Invention |
| 39 | 92.0 | 6.8 | 0.0 | 12.4 | 1.42 | 1.19 | 1.08 | Invention |
| 40 | 89.0 | 10.1 | 0.0 | 11.9 | 1.41 | 1.15 | 1.09 | Invention |
| 41 | 86.0 | 13.3 | 0.0 | 12.9 | 1.32 | 1.27 | 1.06 | Invention |
| 42 | 92.0 | 7.2 | 0.0 | 11.6 | 1.46 | 1.22 | 1.1 | Invention |
| 43 | 90.0 | 9.3 | 0.0 | 12.0 | 1.41 | 1.28 | 1.05 | Invention |
| 44 | 92.0 | 7.0 | 0.0 | 12.0 | 1.48 | 1.33 | 1.05 | Invention |
| 45 | 90.0 | 9.5 | 0.0 | 13.8 | 1.32 | 1.26 | 1.06 | Invention |
| 46 | 87.0 | 11.8 | 0.0 | 8.5 | 1.44 | 1.19 | 1.05 | Comp. Ex. |
| 47 | 79.0 | 20.3 | 0.0 | 9.9 | 1.47 | 1.1 | 1.04 | Comp. Ex. |
| 48 | 72.0 | 27.3 | 0.0 | 10.8 | 1.49 | 1.3 | 1.02 | Comp. Ex. |
| 49 | 90.2 | 5.8 | 3.0 | 9.4 | 1.42 | 1.19 | 1.04 | Comp. Ex. |

Also, various mechanical characteristics were evaluated. The results obtained are shown in Table 4.

The tensile strength and elongation at break were measured in accordance with JIS Z 2241 by using No. 5 test specimen of JIS Z 2201 collected perpendicularly to the rolling direction from the center in the sheet width direction.

The hole expansion percentage was evaluated in accordance with the test method described in JFST 1001-1996 of JFS Standard by using a hole expansion test specimen collected from the center in the sheet width direction.

The side bend elongation was evaluated by the method described in Kokai No. 2009-145138. In this method, a strip-like steel billet was collected from the hot-rolled steel sheet in two directions, that is, the rolling direction and a direction (sheet width direction) perpendicular to the rolling direction, and scribe lines were drawn on a surface of the steel billet. Subsequently, the widthwise edge part in the longitudinal center part of the steel billet was punched out in a semicircular shape, and the punched end face was subjected to tensile bending to generate a crack penetrating the sheet thickness. The strain amount until generation of the crack was measured based on the previously drawn scribe lines.

TABLE 4

| Test No. | Steel | Mechanical Characteristics: Tensile Strength (MPa) | Elongation at Break (%) | Hole Expansion Percentage (%) | Side Bend Elongation in Sheet Width Direction (%) | Side Bend Elongation in Rolling Direction (%) | Side Bend An-isotropy, % rolling/ sheet width × 100 | Remarks |
|---|---|---|---|---|---|---|---|---|
| 1 | A | 508 | 42 | 163 | 86 | 88 | 2.3 | Comp. Ex. |
| 2 | B | 556 | 28 | 108 | 77 | 75 | 2.6 | Comp. Ex. |
| 3 | C | 563 | 34 | 134 | 64 | 62 | 3.1 | Comp. Ex. |
| 4 | D | 552 | 35 | 101 | 71 | 73 | 2.8 | Comp. Ex. |
| 5 | E | 497 | 38 | 168 | 88 | 90 | 2.3 | Comp. Ex. |
| 6 | F | 548 | 29 | 140 | 62 | 65 | 4.8 | Comp. Ex. |
| 7 | G | 561 | 37 | 144 | 69 | 68 | 1.4 | Comp. Ex. |
| 8 | G | 559 | 36 | 132 | 78 | 88 | 12.8 | Invention |
| 9 | G | 543 | 36 | 123 | 72 | 72 | 0.0 | Invention |
| 10 | G | 549 | 33 | 132 | 72 | 76 | 5.6 | Invention |
| 11 | H | 567 | 34 | 130 | 84 | 80 | 4.8 | Invention |
| 12 | H | 559 | 35 | 140 | 80 | 90 | 12.5 | Invention |
| 13 | H | 566 | 34 | 119 | 74 | 76 | 2.7 | Invention |
| 14 | H | 554 | 35 | 145 | 82 | 80 | 2.4 | Invention |
| 15 | H | 566 | 33 | 131 | 74 | 75 | 1.4 | Invention |
| 16 | H | 556 | 32 | 128 | 66 | 66 | 0.0 | Comp. Ex. |
| 17 | I | 552 | 37 | 156 | 65 | 64 | 1.5 | Comp. Ex. |
| 18 | I | 561 | 37 | 133 | 74 | 90 | 21.6 | Invention |
| 19 | I | 566 | 29 | 159 | 80 | 84 | 5.0 | Comp. Ex. |
| 20 | I | 553 | 34 | 155 | 66 | 70 | 6.1 | Comp. Ex. |
| 21 | I | 564 | 28 | 102 | 74 | 71 | 4.1 | Comp. Ex. |
| 22 | I | 545 | 37 | 112 | 68 | 67 | 1.5 | Comp. Ex. |
| 23 | I | 547 | 29 | 142 | 80 | 76 | 5.0 | Comp. Ex. |
| 24 | I | 521 | 35 | 121 | 75 | 78 | 4.0 | Comp. Ex. |
| 25 | I | 550 | 28 | 112 | 72 | 73 | 1.4 | Comp. Ex. |
| 26 | I | 500 | 41 | 165 | 66 | 66 | 0.0 | Comp. Ex. |
| 27 | I | 570 | 35 | 114 | 66 | 71 | 7.6 | Comp. Ex. |
| 28 | I | 558 | 33 | 132 | 74 | 78 | 5.4 | Invention |
| 29 | I | 557 | 33 | 136 | 76 | 72 | 5.3 | Invention |
| 30 | I | 540 | 33 | 148 | 85 | 89 | 4.7 | Invention |
| 31 | I | 541 | 34 | 147 | 78 | 76 | 2.6 | Invention |
| 32 | J | 565 | 37 | 139 | 86 | 89 | 3.5 | Invention |
| 33 | K | 555 | 36 | 146 | 82 | 79 | 3.7 | Invention |
| 34 | L | 611 | 29 | 159 | 74 | 76 | 2.7 | Invention |
| 35 | M | 619 | 33 | 146 | 88 | 90 | 2.3 | Invention |
| 36 | N | 613 | 32 | 150 | 76 | 77 | 1.3 | Invention |
| 37 | O | 619 | 30 | 144 | 73 | 75 | 2.7 | Invention |
| 38 | P | 601 | 28 | 148 | 74 | 76 | 2.7 | Invention |
| 39 | Q | 618 | 28 | 150 | 74 | 77 | 4.1 | Invention |
| 40 | R | 602 | 32 | 136 | 75 | 74 | 1.3 | Invention |
| 41 | S | 553 | 33 | 113 | 81 | 84 | 3.7 | Invention |
| 42 | T | 567 | 35 | 126 | 74 | 77 | 4.1 | Invention |
| 43 | U | 574 | 33 | 115 | 73 | 71 | 2.7 | Invention |
| 44 | V | 588 | 32 | 126 | 76 | 78 | 2.6 | Invention |
| 45 | W | 587 | 35 | 121 | 91 | 90 | 1.1 | Invention |
| 46 | W | 557 | 34 | 122 | 61 | 63 | 3.3 | Comp. Ex. |
| 47 | W | 562 | 30 | 110 | 65 | 66 | 1.5 | Comp. Ex. |
| 48 | W | 556 | 35 | 130 | 67 | 70 | 4.5 | Comp. Ex. |
| 49 | W | 559 | 32 | 115 | 65 | 68 | 4.6 | Comp. Ex. |

As seen in Tables 3 and 4, in the tests where the conditions of the present invention were satisfied, all of tensile strength, elongation, hole expandability and side bend elongation were excellent. However, in Test Nos. 8, 12 and 18, anisotropy of the side bend elongation was confirmed due to slight difference in the production conditions.

On the other hand, in Test No. 1 where the C content was lower than the range of the present invention, a strength of 540 MPa or more was not obtained.

In Test No. 2 where the C content exceeded the range of the present invention, the area fraction of bainite became higher than the range of the present invention, and the ductility and hole expansion percentage were low.

In Test No. 3 where the Si content was lower than the range of the present invention, cementite was excessively produced, and the void formation/connection index L became lower than the range of the present invention. Therefore, despite a high hole expansion percentage, a side bend elongation of 70% or more was not obtained.

In Test No. 4 where the Si content was higher than the range of the present invention, hole expandability of 110% or more was not obtained.

In Test No. 5 where the Mn content was lower than the range of the present invention, bainite was little produced, and a strength of 540 MPa or more was not obtained.

In Test No. 6 where the Mn content was higher than the range of the present invention, a hard second phase was excessively produced, and an elongation of 30% or more was not obtained. That is, the ductility was low.

In Test No. 7 where the reheating temperature of the slab was lower than the range of the present invention, the void formation/connection index L became smaller than the range of the present invention, and a side bend elongation of 70% or more was not obtained.

In Test No. 16 where the cooling rate of secondary cooling was lower than the range of the present invention, coarse cementite was produced, the void formation/connection index L became smaller than the range of the present invention, and a side bend elongation of 70% or more was not obtained.

In Test No. 17 where the reheating time of the slap was shorter than the range of the present invention, the void formation/connection index L became smaller than the range of the present invention, and a side bend elongation of 70% or more was not obtained.

In Test No. 19 where the end temperature of finish rolling was higher than the range of the present invention, ferrite transformation was greatly delayed, and the elongation was low. That is, the ductility was low.

In Test Nos. 20, 46 and 48 where the cooling rate of primary cooling was lower than the range of the present invention, a coarse carbide was produced, the void formation/connection index L became smaller than the range of the present invention, and a side bend elongation of 70% or more was not obtained.

In Test No. 21 where the primary cooling stop temperature was lower than the range of the present invention, ferrite transformation did not proceed, and the elongation was low. That is, the ductility was worsened.

In Test No. 22 where the primary cooling stop temperature was higher than the range of the present invention, a second phase was coarsened, and the side bend elongation was reduced.

In Test No. 23 where the air cooling time was shorter than the range of the present invention, ferrite transformation did not proceed, and the elongation was low. That is, the ductility was worsened.

In Test No. 24 where the air cooling time was longer than the range of the present invention, pearlite was produced, and bainite was not obtained, as a result, the strength was reduced.

In Test No. 25 where the coiling temperature was lower than the range of the present invention, bainite became excessive, and the ductility was low. In Test No. 26 where the coiling temperature was higher than the range of the present invention, a strength of 540 MPa or more was not obtained. Also, a carbide was coarsened, and the side bend elongation was low.

In Test Nos. 27, 47 and 49 where the cooling rate after coiling was lower than the range of the present invention, cementite was coarsened, the void formation/connection index L became smaller than the range of the present invention, and a side bend elongation of 70% or more was not obtained.

FIG. 1 shows the results where out of the measurement results obtained in these tests, the tensile strength was 540 MPa or more and at the same time, the hole expansion percentage was 110% or more.

The present invention has bee described in detail in the foregoing pages. Needless to say, implementation of the present invention may not be limited to the embodiments illustrated in the description of the present invention.

INDUSTRIAL APPLICABILITY

According to the present invention, in regard to a high-tensile steel not lower than 540 MPa class, a steel sheet with excellent press formability, which is easily workable and has not only hole expandability but also stretch flanging workability, can be produced. Accordingly, the present invention can be utilized not only in the iron and steel industry but also in wide range of industries such as the automobile industry using a steel sheet.

The invention claimed is:

1. A hot-rolled steel sheet with excellent press formability, consisting of, in mass %, C: 0.03 to 0.10%,
Si: 0.6 to 1.5%,
Mn: 0.5 to 2.0%,
Nb: 0-0.08%,
Ti: 0-0.2%,
W: 0-0.5%,
Mo: 0-0.4%,
Cu: 0-1.2%,
Ni: 0-0.6%,
Cr: 0-1.0%,
B: 0-0.005%,
Ca: 0-0.01%, and
REM: 0-0.01%, and having a balance of Fe and unavoidable impurities, as impurities, P: limited to 0.05% or less,
S: limited to 0.01% or less,
Al: limited to 0.30% or less,
N: limited to 0.01% or less, wherein the hot-rolled steel sheet has a tensile strength of at least 540 MPa, and wherein in the steel sheet, the X-ray random intensity ratios of {211} plane parallel to a surface of the steel sheet at the ½ thickness position, the ¼ thickness position, and the ⅛ thickness position in the thickness direction from the surface are 1.5 or less, 1.3 or less, and 1.1 or less, respectively, and wherein in the metallic structure of said steel sheet, the area fraction of ferrite is 70% or more, the area fraction of bainite is 30% or less, the area fraction of either one or both of martensite having an area of 0.1 $\mu m^2$ or more and retained austenite having an area of 0.1 $\mu m^2$ or more is 2% or less, and with regard to respective average intervals, average diameters and number densities of a cementite having an area of 0.1 $\mu m^2$ or more, an inclusion having an area of 0.05 $\mu m^2$ or more and either one or both of the martensite and the retained austenite, a void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities of the cementite, the inclusion and either one or both of the martensite and the retained austenite, respectively, and the unit is pieces/$\mu m^2$;

$D_\theta$, $D_i$ and $D_{MA}$: average diameters of the cementite, the inclusion and either one or both of the martensite and the retained austenite, respectively, and the unit is $\mu m$; and $L_\theta$, $L_i$ and $L_{MA}$: average intervals of the cementite, the inclusion and either one or both of the martensite and the retained austenite, respectively, and the unit is $\mu m$.

2. A method for producing a hot-rolled steel sheet with excellent press formability, comprising:

a step of reheating a slab to a temperature of 1,150° C. or more and holding the slab for 120 minutes or more and 180 minutes or less, thereafter performing rough rolling the slab, a step of performing finish rolling such that the end temperature becomes between $Ae_{3-30}$° C. and $Ae_3$+30° C., wherein a total length of time between passes in a final 4 passes in said finish rolling is 3 seconds or less, a step for performing primary cooling to a temperature between 510 and 650° C. at a cooling rate of 50° C./s or more, the primary cooling being started between 0.9 seconds and 2.0 seconds after the completion of the finish rolling, a step of performing air cooling for 2 to 5 seconds, a step of performing secondary cooling at a cooling rate of 30° C./s or more, a step of performing coiling at a temperature of 500 to 600° C., and a step of performing cooling to 200° C. or less at an average cooling rate of 30° C./h or more to obtain a steel sheet, wherein:

$$Ae_3=937-477C+56Si-20Mn-16Cu-15Ni-5Cr+38Mo+136Ti-19Nb+198Al+3315B \quad \text{(formula 2)}$$

wherein C, Si, Mn, Cu, Ni, Cr, Mo, Ti, Nb, Al and B represent the contents of respective elements, and the unit is mass %:

wherein the slab is made of a steel consisting of, in mass %,

C: 0.03 to 0.10%,
Si: 0.6 to 1.5%,
Mn: 0.5 to 2.0%,
Nb: 0-0.08%,
Ti: 0-0.2%,
W: 0-0.5%,
Mo: 0-0.4%,
Cu: 0-1.2%,
Ni: 0-0.6%,
Cr: 0-1.0%,
B: 0-0.005%,
Ca: 0-0.01%, and
REM: 0-0.01%, and having a balance of Fe and unavoidable impurities, as impurities, P: limited to 0.05% or less,
S: limited to 0.01% or less,
Al: limited to 0.30% or less,
N: limited to 0.01% or less, wherein the hot-rolled steel sheet has a tensile strength of at least 540 M Pa, and wherein in the steel sheet, the X-ray random intensity ratio of {211} plane parallel to a surface of the steel sheet at the ½ thickness position, the ¼ thickness position, and the ⅛ thickness position in the thickness direction from the surface are 1.5 or less, 1.3 or less, and 1.1 or less, respectively.

3. The method for producing a hot-rolled steel sheet with excellent press formability according to claim 2, wherein with regard to respective average intervals, average diameters and number densities of a cementite having an area of 0.1 μm² or more, an inclusion having an area of 0.05 μm² or more and either one or both of the martensite and the retained austenite in the metallic structure of said steel sheet, the void formation/connection index L defined by formula 1 is 11.5 or more:

$$L=\frac{n_\theta L_\theta/D_\theta^2+2.1n_iL_i/D_i^2+n_{MA}L_{MA}/D_{MA}^2}{n_\theta+n_i+n_{MA}} \quad \text{(formula 1)}$$

$n_\theta$, $n_i$ and $n_{MA}$: number densities of the cementite, the inclusion and either one or both of the martensite and the retained austenite, respectively, and the unit is pieces/μm²;

$D_\theta$, $D_i$ and $D_{MA}$: average diameters of the cementite, the inclusion and either one or both of the martensite and the retained austenite, respectively, and the unit is μm; and $L_\theta$, $L_i$ and $L_{MA}$: average intervals of the cementite, the inclusion and either one or both of the martensite and the retained austenite, respectively, and the unit is μm.

4. A hot-rolled steel sheet with excellent press formability, comprising, in mass %, C: 0.03 to 0.10%,
Si: 0.6 to 1.5%,
Mn: 0.5 to 2.0%,
Nb: 0-0.08%,
Ti: 0-0.2%,
W: 0-0.5%,
Mo: 0-0.4%,
Cu: 0-1.2%,
Ni: 0-0.6%,
Cr: 0-1.0%,
B: 0-0.005%,
Ca: 0-0.01%, and
REM: 0-0.01%, and having a balance of Fe and unavoidable impurities, as impurities, P: limited to 0.05% or less,
S: limited to 0.01% or less,
Al: limited to 0.30% or less,
N: limited to 0.01% or less, wherein the hot-rolled steel sheet has a tensile strength of at least 540 MPa, and wherein in the steel sheet, the X-ray random intensity ratio of {211} plane parallel to a surface of the steel sheet at the ½ thickness position, the ¼ thickness position, and the ⅛ thickness position in the thickness direction from the surface are 1.5 or less, 1.3 or less, and 1.1 or less, respectively, and with the proviso that said steel sheet contains no vanadium;

wherein the hot-rolled steel sheet has a tensile strength of at least 540 MPa, and wherein in the steel sheet, the X-ray random intensity ratio of {211} plane parallel to a surface of the steel sheet at the ½ thickness position, the ¼ thickness position, and the ⅛ thickness position in the thickness direction from the surface are 1.5 or less, 1.3 or less, and 1.1 or less, respectively, and wherein in the metallic structure of said steel sheet, the area fraction of ferrite is 70% or more, the area fraction of bainite is 30% or less, the area fraction of either one or both of martensite having an area of 0.1 μm² or more and retained austenite having an area of 0.1 μm² or more is 2% or less, and with regard to respective average intervals, average diameters and number densities of a cementite having an area of 0.1 μm² or more, an inclusion having an area of 0.05 μm² or more and either one or both of the martensite and the retained austenite, a void formation/connection index L defined by formula 1 is 11.5 or more:

$$L = \frac{n_\theta L_\theta / D_\theta^2 + 2.1 n_i L_i / D_i^2 + n_{MA} L_{MA} / D_{MA}^2}{n_\theta + n_i + n_{MA}} \quad \text{(formula 1)}$$

$n_\theta$, $n_i$ and $n_{MA}$: number densities of the cementite, the inclusion and either one or both of the martensite and the retained austenite, respectively, and the unit is pieces/$\mu m^2$;

$D_\theta$, $D_i$ and $D_{MA}$: average diameters of the cementite, the inclusion and either one or both of the martensite and the retained austenite, respectively, and the unit is μm; and $L_\theta$, $L_i$ and $L_{MA}$: average intervals of the cementite, the inclusion and either one or both of the martensite and the retained austenite, respectively, and the unit is μm.

5. A method for producing a hot-rolled steel sheet with excellent press formability, comprising:

a step of reheating a slab to a temperature of 1,150° C. or more and holding the slab for 120 minutes or more and 180 minutes or less, thereafter performing rough rolling the slab, a step of performing finish rolling such that the end temperature becomes between Ae3-30° C. and Ae3+30° C., a step for performing primary cooling to a temperature between 510 and 650° C. at a cooling rate of 50° C./s or more, the primary cooling being started between 0.9 seconds and 2.0 seconds after the completion of the finish rolling, a step of performing air cooling for 2 to 5 seconds, a step of performing secondary cooling at a cooling rate of 30° C./s or more, a step of performing coiling at a temperature of 500 to 600° C., and a step of performing cooling to 200° C. or less at an average cooling rate of 30° C./h or more to obtain a steel sheet, wherein:

$$Ae_3 = 937 - 477C + 56Si - 20Mn - 16Cu - 15Ni - 5Cr + 38Mo + 136Ti - 19Nb + 198A1 + 3315B \quad \text{(formula 2)}$$

wherein C, Si, Mn, Cu, Ni, Cr, Mo, Ti, Nb, Al and B represent the contents of respective elements, and the unit is mass %, and wherein the slab is made of a steel comprising, in mass %, C: 0.03 to 0.10%, Si: 0.6 to 1.5%, Mn: 0.5 to 2.0%, Nb: 0-0.08%, Ti: 0-0.2%,

W: 0-0.5%,

Mo: 0-0.4%,

Cu: 0-1.2%,

Ni: 0-0.6%,

Cr: 0-1.0%,

B: 0-0.005%,

Ca: 0-0.01%, and

REM: 0-0.01%, and having a balance of Fe and unavoidable impurities, as impurities, P: limited to 0.05% or less, S: limited to 0.01% or less, Al: limited to 0.30% or less, N: limited to 0.01% or less, with the proviso that said steel sheet contains no vanadium, wherein the hot-rolled steel sheet has a tensile strength of at least 540 MPa, and wherein in the steel sheet, the X-ray random intensity ratio of {211} plane parallel to a surface of the steel sheet at the ½ thickness position, the ¼ thickness position, and the ⅛ thickness position in the thickness direction from the surface are 1.5 or less, 1.3 or less, and 1.1 or less, respectively.

* * * * *